US008185036B2

(12) United States Patent
Aoki

(10) Patent No.: US 8,185,036 B2
(45) Date of Patent: May 22, 2012

(54) MEDIUM TRANSPORT APPARATUS, IMAGE FORMING APPARATUS AND MEDIUM TRANSPORT METHOD

(75) Inventor: Hiroyuki Aoki, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 524 days.

(21) Appl. No.: 12/404,005

(22) Filed: Mar. 13, 2009

(65) Prior Publication Data

US 2009/0238619 A1 Sep. 24, 2009

(30) Foreign Application Priority Data

Mar. 21, 2008 (JP) ..... 2008-072952
May 28, 2008 (JP) ..... 2008-139321

(51) Int. Cl.
*B41F 1/34* (2006.01)
*G03G 15/00* (2006.01)

(52) U.S. Cl. ..... 399/384; 399/394; 101/485

(58) Field of Classification Search ..... 399/384, 399/394; 101/180, 183, 221, 484, 485
See application file for complete search history.

(56) References Cited

U.S. PATENT DOCUMENTS 5,313,886 A * 5/1994 Muller ..... 101/486
5,450,164 A * 9/1995 Negishi et al. ..... 399/18
6,199,480 B1 * 3/2001 Leonhardt et al. ..... 101/248
6,622,621 B2 * 9/2003 Bucher et al. ..... 101/228
2006/0056894 A1 3/2006 Kawashima et al.

FOREIGN PATENT DOCUMENTS

| | | |
|---|---|---|
| GB | 2 065 871 | 7/1981 |
| JP | 58-72484 | 4/1983 |
| JP | 63-031973 | 2/1988 |
| JP | 08-052864 | 2/1996 |
| JP | 11-020993 | 1/1999 |
| JP | 2005-131928 | 5/2005 |
| JP | 2006-082430 | 3/2006 |
| JP | 2006-227375 | 8/2006 |
| JP | 2006-335515 | 12/2006 |
| WO | WO 03/037722 | 5/2003 |

* cited by examiner

*Primary Examiner* — Ren Yan
*Assistant Examiner* — Ruben Parco, Jr.
(74) *Attorney, Agent, or Firm* — Morgan, Lewis & Bockius LLP

(57) ABSTRACT

The medium transport apparatus is provided with: a transport unit that transports a recording medium continuing in a direction, in the direction where the recording medium continues; a detection unit that detects a mark formed on the recording medium transported by the transport unit, by using a detection effective range smaller than a dimension of the mark in a direction crossing a transport direction of the recording medium; a positional relationship identification unit that identifies a relative positional relationship between the detection unit and the mark in the direction crossing the transport direction, from a detection result obtained by the detection unit; and a move unit that moves the detection unit in the direction crossing the transport direction, on the basis of the relative positional relationship identified by the positional relationship identification unit.

13 Claims, 22 Drawing Sheets

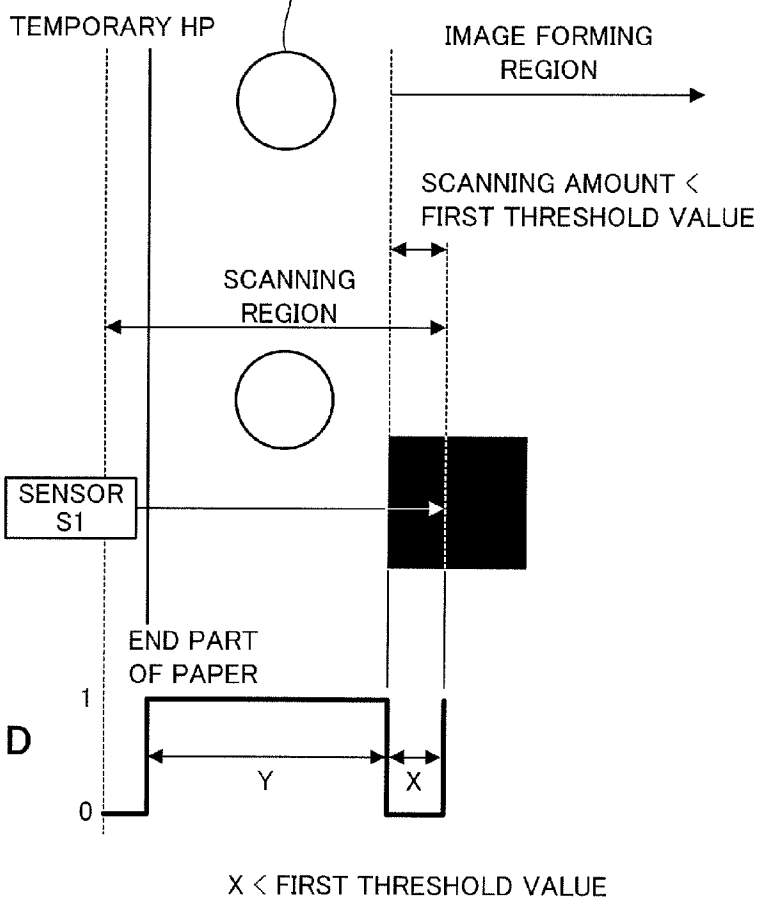
FIG.11C
FIG.11D
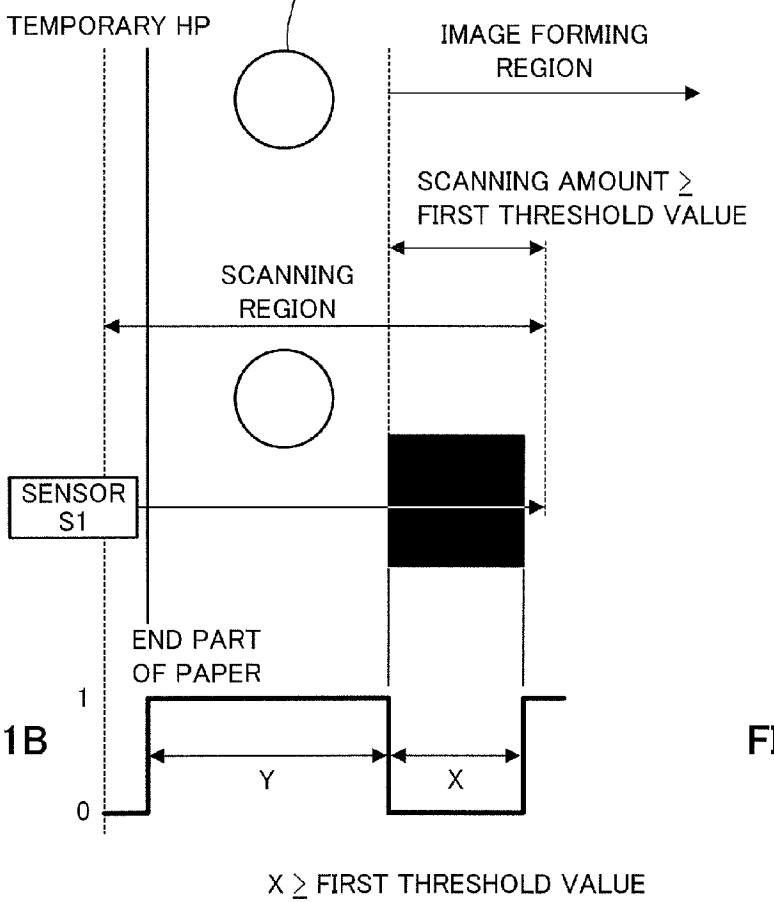
FIG.11A
FIG.11B

BEFORE EXECUTION OF THE MARK TRACKING CONTROL PROCESSING

AFTER EXECUTION OF THE MARK TRACKING CONTROL PROCESSING

MEDIUM TRANSPORT APPARATUS, IMAGE FORMING APPARATUS AND MEDIUM TRANSPORT METHOD

CROSS REFERENCE TO RELATED APPLICATIONS

This application is based on and claims priority under 35 USC §119 from Japanese Patent Applications No. 2008-72952 filed Mar. 21, 2008, and No. 2008-139321 filed May 28, 2008.

BACKGROUND

1. Technical Field

The present invention relates to a medium transport apparatus, an image forming apparatus and a medium transport method.

2. Related Art

As an example of an image forming apparatus for forming images on a recording medium, there is an image forming apparatus that performs image formation on continuous paper continued in a predetermined direction (a slow scan direction at the image formation, for example).

SUMMARY

According to an aspect of the invention, there is provided a medium transport apparatus including: a transport unit that transports a recording medium continuing in a direction, in the direction where the recording medium continues; a detection unit that detects a mark formed on the recording medium transported by the transport unit, by using a detection effective range smaller than a dimension of the mark in a direction crossing a transport direction of the recording medium; a positional relationship identification unit that identifies a relative positional relationship between the detection unit and the mark in the direction crossing the transport direction, from a detection result obtained by the detection unit; and a move unit that moves the detection unit in the direction crossing the transport direction, on the basis of the relative positional relationship identified by the positional relationship identification unit.

BRIEF DESCRIPTION OF THE DRAWINGS

Exemplary embodiment(s) of the present invention will be described in detail based on the following figures, wherein:

FIGS. 11A to 11D are views for explaining a scanning region of the first sensor;

DETAILED DESCRIPTION

First Exemplary Embodiment

A first exemplary embodiment of the present invention will be described below in detail with reference to the accompanying drawings.

Figure 1:
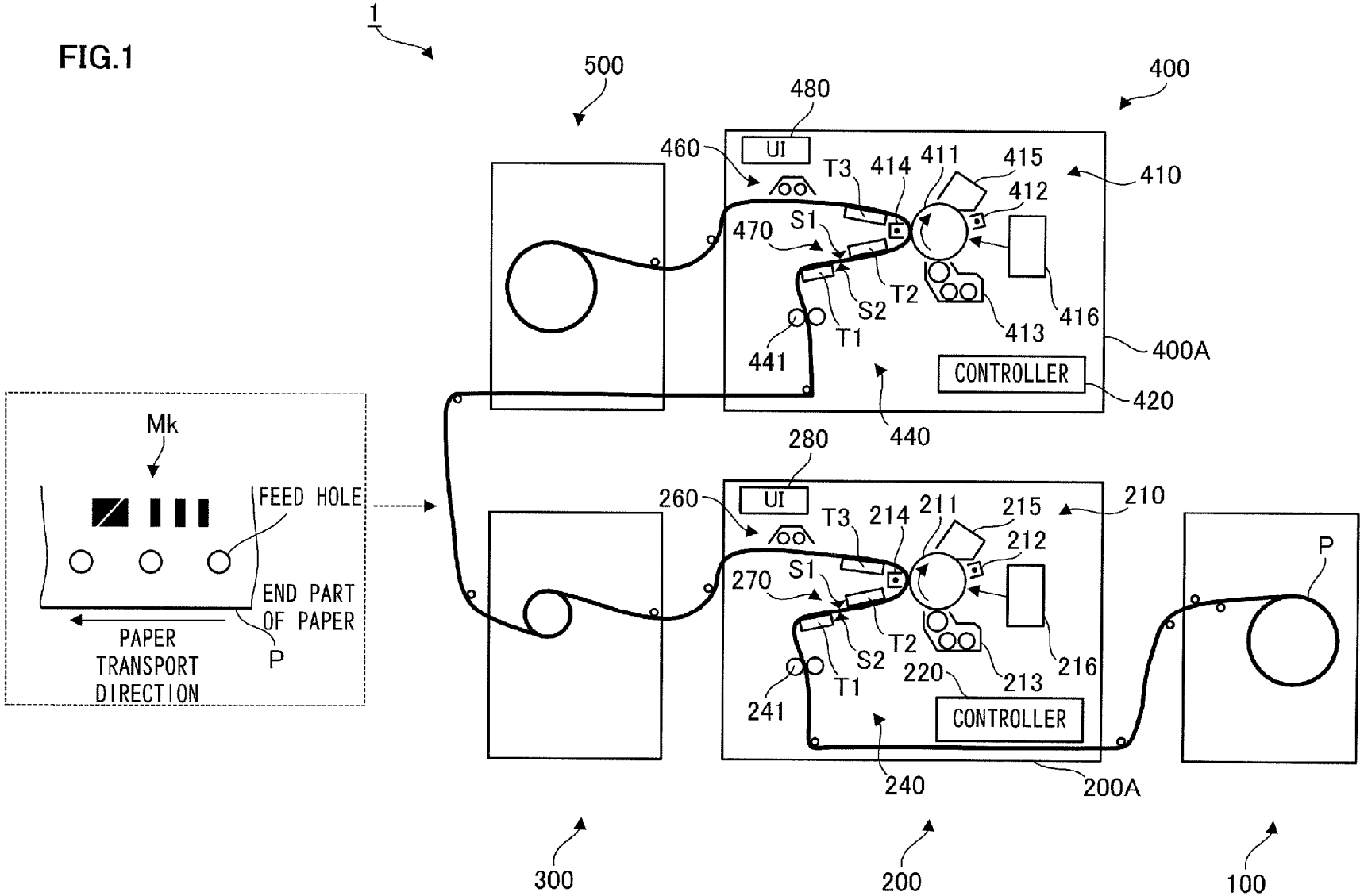
FIG. 1 is a schematic diagram showing a configuration example of an image forming system to which the present invention is applied.

FIG. 1 is a schematic diagram showing a configuration example of an image forming system to which the present invention is applied.

As shown in FIG. 1, an image forming system 1 of the first exemplary embodiment includes: a feeder 100 that feeds continuous paper (web paper) P; a first image forming apparatus 200 that is disposed on an upstream side in a transport direction of the continuous paper P; and a reversing apparatus 300 that reverses the continuous paper P. In addition, the image forming system 1 also includes: a second image forming apparatus 400 that is disposed on a downstream side in the transport direction of the continuous paper P, with respect to the first image forming apparatus 200; and a winding-up apparatus 500 that winds up the continuous paper P.

The feeder 100 holds the continuous paper P wound up in a roll, and also feeds the continuous paper P to the first image forming apparatus 200. The feeder 100 includes a detection sensor (not shown in the figure) that detects sag of the continuous paper P on a transport path for the continuous paper P to the first image forming apparatus 200, for example. Accordingly, when the first image forming apparatus 200 transports the continuous paper P and consequently no sag of the continuous paper P is detected by the detection sensor, the feeder 100 feeds (sends out) the continuous paper P.

Here, the image forming system 1 of the first exemplary embodiment is capable of using both the continuous paper P having feed holes (sprocket holes) (i.e., pin-feed continuous paper P) and the continuous paper P having no feed holes (i.e. pinless continuous paper P).

The reversing apparatus 300 reverses the continuous paper P transported from the first image forming apparatus 200, and also feeds the reversed continuous paper P to the second image forming apparatus 400. The reversing of the continuous paper P by the reversing apparatus 300 is performed, for example, by providing a turn bar (not shown in the figure) having an inclination angle of 45° with respect to the transport direction of the continuous paper P.

The winding-up apparatus 500 winds up the continuous paper P discharged from the second image forming apparatus 400. The winding-up apparatus 500 includes a detection sensor (not shown in the figure) that detects sag of the continuous paper P, on the transport pass for the continuous paper P. When the detection sensor detects sag of the continuous paper P, the winding-up apparatus 500 winds up the continuous paper P.

Next, the first image forming apparatus 200 and the second image forming apparatus 400 are described. Here, since the first image forming apparatus 200 and the second image forming apparatus 400 have the same configuration, only the second image forming apparatus 400 is described in detail below.

As shown in FIG. 1, the second image forming apparatus 400 includes, inside an apparatus body 400A, an image forming unit 410 that performs image formation on the basis of inputted image data. Further, the second image forming apparatus 400 includes a controller 420 that controls operations of units and devices included in the second image forming apparatus 400. Furthermore, the second image forming apparatus 400 includes a paper transport unit 440 that causes the transported continuous paper P to pass the image forming unit 410 and then discharges the continuous paper P outside. Still furthermore, the second image forming apparatus 400 includes a fixing device 460, functioning as a fixing unit, which is provided with a flash lamp, for example, and which fixes a toner image formed on the continuous paper P by the image forming unit 410. Moreover, the second image forming apparatus 400 includes a user interface (UI) 480 that receives an information input by the operator and displays information to the operator.

The image forming unit 410 includes: a photoconductive drum 411, as an example of an image carrier, which rotates in the direction indicated by an arrow in FIG. 1, and thereby an electrostatic latent image is formed thereon; a charging device (charge corotron) 412 that charges a surface of the photoconductive drum 411; a developing device 413 that develops the electrostatic latent image formed on the photoconductive drum 411 with toner; a transfer device (transfer corotron) 414, forming a transfer unit, which transfers the toner image formed on the photoconductive drum 411 onto the continuous paper P; and a cleaning unit 415 that cleans the surface of the photoconductive drum 411 after the transfer. Further, the image forming unit 410 includes a laser exposure device 416 that exposes the photoconductive drum 411. The laser exposure device 416 performs scan exposure on the photoconductive drum 411 with a laser beam, the lighting of which is controlled on the basis of the acquired image data.

The paper transport unit 440, functioning as a transport unit, includes back tension rolls 441 that are provided so as to be capable of rotating reversely and that transport the continuous paper P transported from the reversing apparatus 300, to the image forming unit 410. Further, the paper transport unit 440 includes: an aligning roll (not shown in the figure) that is provided on a downstream side in the transport direction of the continuous paper P with respect to the back tension rolls 441; and a guide wall (not shown in the figure) that is disposed on a front side of the apparatus body 400A while being arranged along the transport direction of the continuous paper P, and that guides the continuous paper P. Here, the aligning roll aligns the continuous paper P by causing the continuous paper P to hit the guide wall when the pinless continuous paper P is transported.

Furthermore, the paper transport unit 440 includes: a first tractor T1 and a second tractor T2 that are disposed on the downstream side in the transport direction of the continuous paper P with respect to the back tension rolls 441, and that transport the pin-feed continuous paper P to the transfer unit; and a third tractor T3 that transports the pin-feed continuous paper P having passed the transfer unit, toward the fixing device 460. In addition, the paper transport unit 440 includes a mark detection mechanism 470 that is disposed between the first tractor T1 and the second tractor T2, that includes a first sensor S1 and a second sensor S2, and that detects marks Mk formed (printed) on the continuous paper P by the first image forming apparatus 200.

Figure 2:
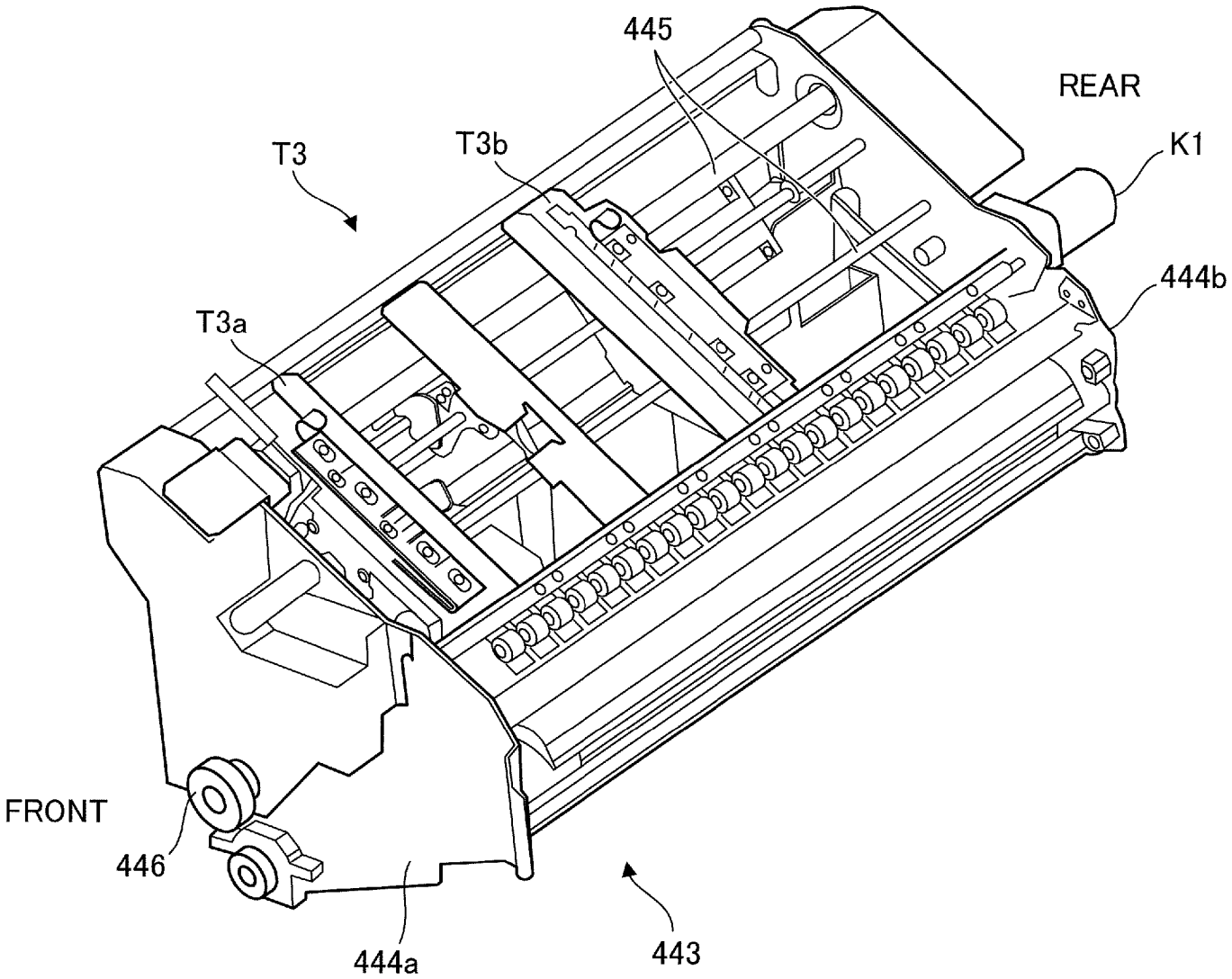
FIG. 2 is a perspective view for explaining the third tractor.

The first tractor T1 to the third tractor T3 are described below by taking the third tractor T3 as an example. FIG. 2 is a perspective view for explaining the third tractor T3. In FIG. 2, the upper right side corresponds to the rear side of the apparatus body 400A (i.e., the back side of the apparatus), while the lower left side corresponds to the front side of the apparatus body 400A (i.e., the front side of the apparatus).

As shown in FIG. 2, the third tractor T3 of the first exemplary embodiment is supported by a support unit 443 supported by the apparatus body 400A.

The third tractor T3 includes: multiple pins (not shown in the figure) to be disposed so as to respectively penetrate feed holes formed on one end side of the pin-feed continuous paper P; and a first tractor portion T3*a* that drives the pins so that the pins would circulate. Further, the third tractor T3 includes: multiple pins to be disposed so as to penetrate feed holes formed on the other end side of the pin-feed continuous paper P; and a second tractor portion T3*b* that drives the pins so that the pins would circulate.

The support unit 443 includes: support plates 444*a* and 444*b* that are disposed along the transport direction of the continuous paper P and that are arranged so as to face each other; multiple shafts 445 that are supported, at their both ends, by the support plates 444*a* and 444*b*; and a rotation portion 446 that rotates upon receipt of an operation by the operator. Further, the support unit 443 includes a tractor drive motor K1 that supplies drive power to the first tractor portion T3*a* and the second tractor portion T3*b* to cause the pins in the first tractor portion T3*a* and the second tractor portion T3*b* to drive in a circulating manner.

The second tractor portion T3*b* is provided so as to be slidable in directions orthogonal to the transport direction of the continuous paper P (also referred to as "fast scan directions" below). In addition, the second tractor portion T3*b* is provided so as to work with the rotation portion 446 through the shafts 445, and thereby, when the rotation portion 446 rotates, the second tractor portion T3*b* slides in a corresponding fast scan direction. Thus, in the first exemplary embodiment, even when the width of the continuous paper P is changed, the second tractor portion T3*b* is disposed in a position corresponding to the paper width of the continuous paper P by an operation of the rotation portion 446.

In the first exemplary embodiment, firstly, the first image forming apparatus 200 performs image formation on a first surface (top surface) of the continuous paper P. Then, the reversing apparatus 300 reverses the continuous paper P, and the reversed continuous paper P is fed to the second image forming apparatus 400. Thereafter, the second image forming apparatus 400 performs image formation on a second surface (back surface) of the continuous paper P. Finally, the winding-up apparatus 500 winds up the continuous paper P with the image formed thereon.

Specifically, the feeder 100 feeds pin-feed continuous paper P, for example, to the first image forming apparatus 200. Then, by back tension rolls 241, a first tractor T1 and a second tractor T2 of the first image forming apparatus 200, the continuous paper P is transported to the transfer unit. Meanwhile, in the first image forming apparatus 200, inputted image data is provided to a laser exposure device 216. Thereafter, a surface of a photoconductive drum 211 uniformly charged by a charging device 212 at a predetermined potential is subjected to scan exposure with a laser beam, the lighting of which is controlled by the laser exposure device 216. Thereby, an electrostatic latent image is formed on the photoconductive drum 211. The electrostatic latent image thus formed is developed by a developing device 213, and a toner image is consequently formed on the photoconductive drum 211. The toner image is transferred onto the first surface of the continuous paper P by a transfer device 214.

Subsequently, the third tractor T3 transports the continuous paper P, onto which the toner image is transferred, to a fixing device 260. Here, the unfixed toner image on the continuous paper P is subjected to a fixing process using heat by the fixing device 260, and is thereby fixed to the continuous paper P. Then, after being reversed by the reversing apparatus 300, the continuous paper P is fed to the second image forming apparatus 400. In the first image forming apparatus 200 of the first exemplary embodiment, an image forming unit 210, functioning as a mark forming unit, forms the marks Mk at an end part of the first surface of the continuous paper P for the purpose of allowing the second image forming apparatus 400 to identify an image forming start position and to align images on the top and back surfaces of the continuous paper P.

Then, the continuous paper P fed to the second image forming apparatus 400 is transported to the transfer unit by the back tension rolls 441, the first tractor T1 and the second tractor T2, as in the first image forming apparatus 200. In this process, each mark Mk formed on the first surface of the continuous paper P is detected by the mark detection mechanism 470. Meanwhile, the surface of the photoconductive drum 411 uniformly charged by the charging device 412 at a predetermined potential is subjected to scan exposure with a laser beam, the lighting of which is controlled by the laser exposure device 416. Thereby, an electrostatic latent image is formed on the photoconductive drum 411. Here, the timing and the position of scan exposure by the laser exposure device 416 are determined on the basis of a detection result obtained by the mark detection mechanism 470. The electrostatic latent image thus formed is developed by the developing device 413, and a toner image is consequently formed on the photoconductive drum 411. The toner image is then transferred onto the second surface of the continuous paper P by the transfer device 414.

The continuous paper P with the toner image transferred thereonto is transported to the fixing device 460 by the third tractor T3. The unfixed toner image on the continuous paper P transported to the fixing device 460 is subjected to a fixing process using heat by the fixing device 460, and is thereby fixed to the continuous paper P. Thereafter, the continuous paper P is discharged from the second image forming apparatus 400, and then wound up by the winding-up apparatus 500. In the case where the pinless continuous paper P is transported, the first tractor T1 to the third tractor T3 move in a corresponding width direction of the continuous paper P (fast scan direction), and the pinless continuous paper P is transported by the back tension rolls 241 and 441, a transport roll not shown in the figure, and the like.

Next, the mark detection mechanism 470 is described.

Figure 3:
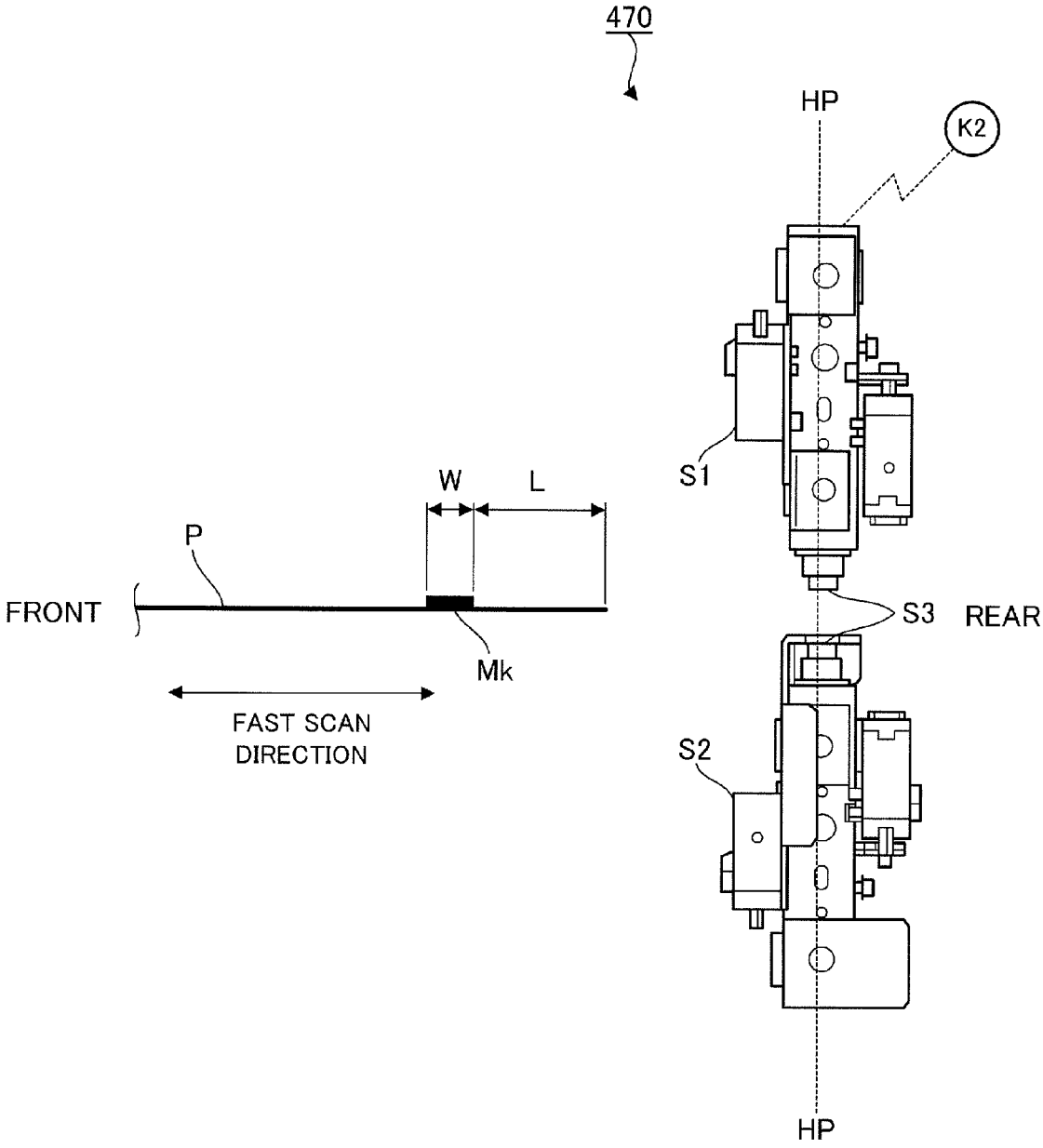
FIG. 3 is a view for explaining the mark detection mechanism.

FIG. 3 is a view for explaining the mark detection mechanism 470. In FIG. 3, the right side corresponds to the rear side, while the left side corresponds to the front side. Accordingly, FIG. 3 shows a state in which the continuous paper P is transported from the back side to the front side of the sheet on which FIG. 3 is drawn.

As shown in FIG. 3, the mark detection mechanism 470 includes: the first sensor S1 as an example of a detection unit that detects (senses) the marks Mk formed on the first surface of the continuous paper P by the first image forming apparatus 200; and the second sensor S2 that detects, when a mark is formed on the second surface of the continuous paper P in advance, the mark on the second surface. Here, the first sensor S1 and the second sensor S2 are disposed to have a relationship of facing each other. In addition, the mark detection mechanism 470 includes an end part detection sensor S3 that detects a rear-side end part of the continuous paper P. Moreover, the mark detection mechanism 470 includes a motor K2 that moves the first sensor S1, the second sensor S2 and the end part detection sensor S3 in a corresponding fast scan direction (width directions of the continuous paper P). The motor K2 of the first exemplary embodiment is formed by a stepping motor.

In the image forming system 1 of the first exemplary embodiment, the position of the mark Mk in the fast scan directions, the width of the mark Mk and the like are settable by the operator. Specifically, a distance L from the end part of the continuous paper P to the mark Mk and a width W of the mark Mk are settable. Such settings are received at a UI 280 provided in the first image forming apparatus 200 or a terminal device (not shown in the figure) such as a personal computer (PC), for example. Then, the information on the distance L, the width W and the like is notified to the second image forming apparatus 400. Thereby, the controller 420 of the second image forming apparatus 400 causes the motor K2 to drive a certain amount based on the distance L and the width W, to move the first sensor S1 from a home position HP to a position facing the mark Mk.

Figure 4:
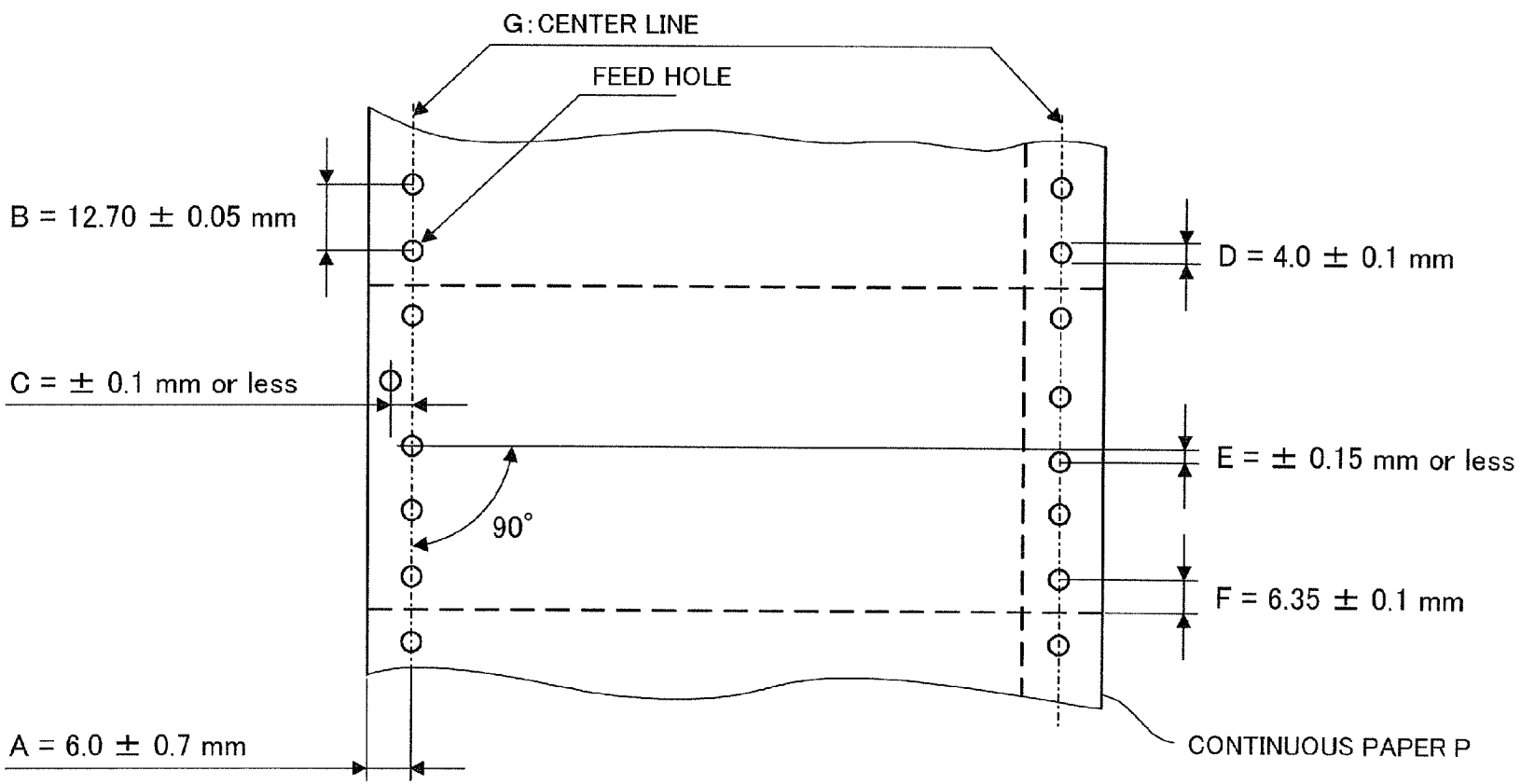
FIG. 4 is a view for explaining a standard on which the pin-feed continuous paper is based.

Since the pin-feed continuous paper P is generally manufactured on the basis of a specific standard such as a JIS standard, the feed holes have a predetermined diameter and predetermined intervals. For example, as shown in FIG. 4 (a view for explaining a standard on which the pin-feed continuous paper P is based), each feed hole (G: center line) is formed in a position that is 6.0±0.7 mm apart from the end part of the continuous paper P (see A in FIG. 4). Moreover, feed holes are formed at 12.70±0.05 mm intervals (see B in FIG. 4). Furthermore, each feed hole is formed to have a diameter of 4.0±0.1 mm (see D in FIG. 4).

Although the pin-feed continuous paper P is generally manufactured under a specific standard as described above, the pin-feed continuous paper P that does not satisfy the specific standard may be manufactured in some cases. In such a case, a situation in which the mark Mk on the continuous paper is not detected arises.

Figure 5B:
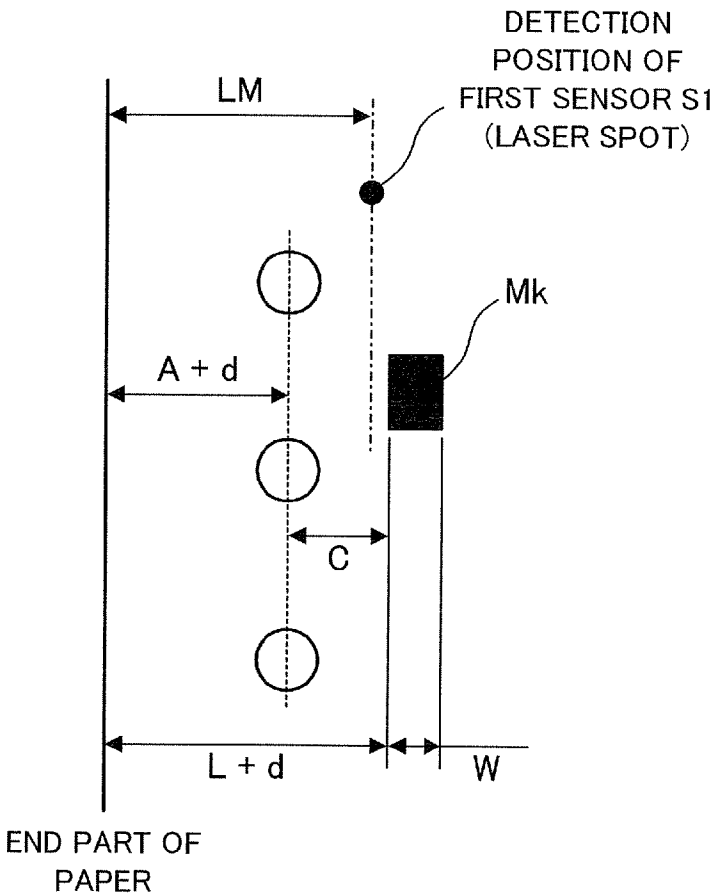
FIGS. 5A and 5B are views for explaining detection of the mark by the first sensor.
Figure 5A:
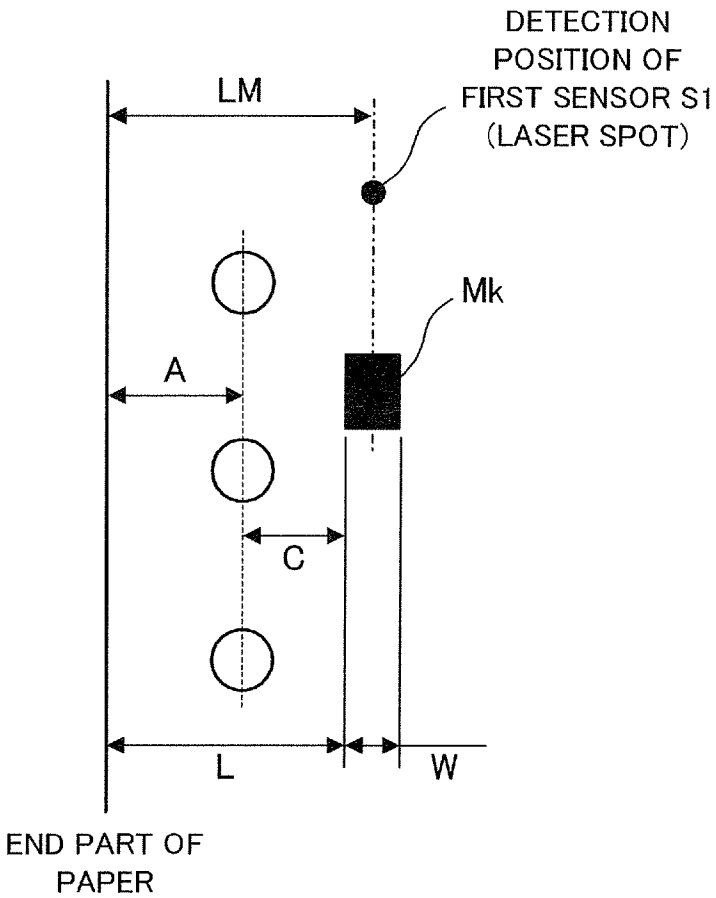

FIGS. 5A and 5B are views for explaining detection of the mark Mk by the first sensor S1.

As described above, the second image forming apparatus 400 is informed of the distance L from the end part of the continuous paper P to the mark Mk and the width W of the mark Mk. Then, on the basis of the distance L and the width W, the controller 420 causes the motor K2 to drive, in order to move the first sensor S1. Specifically, the controller 420 performs calculations (L+W/2) on the basis of the distance L and the width W, to set a position having a distance (L+W/2) from the end part of the continuous paper P (referred to as a "distance LM" below) to be the destination position to which the first sensor S1 to be moved. Then, the controller 420 causes the motor K2 to drive, in order to move the first sensor S1 to the destination position (see FIG. 5A). As a result, the mark Mk passes a detection position (detection region) of the first sensor S1, and thereby successful detection of the mark Mk by the first sensor S1 is performed. Here, the distance L, the width W and the distance LM correspond to position information on the mark Mk formed on the continuous paper P.

If the distance A (see also FIG. 4) from the end part of the continuous paper P to each feed hole does not satisfy the standard, and each feed hole is formed in a position having a distance that is longer than the distance A, i.e., the standard value, by a distance d, from the end part of the continuous paper P, for example, the formation position of the mark Mk deviates from the appropriate position in the fast scan directions. Specifically, when each feed hole is formed in the position having a distance that is longer than the distance A by the distance d, the continuous paper P in the state of deviating from the appropriate position by the distance d in the fast scan directions is transported at the time of formation of the mark Mk by the first image forming apparatus 200. Thus, the mark Mk is formed on the continuous paper P thus deviating.

Consequently, as shown in FIG. 5B, the mark Mk is formed in a position that is behind the appropriate position for the distance d, with reference to the end part of the continuous paper P. This prevents them ark Mk from passing the detection position (detection spot (laser spot)) of the first sensor S1, which makes detection of the mark Mk difficult. In view of such a situation, in the first exemplary embodiment, processing of changing the position of the first sensor S1 on the basis of a deviation amount of the feed holes is performed to allow successful detection of the mark Mk even when the continuous paper P that does not satisfy the standard is transported. Here, no relative change is made in the position of each pin (not shown in the figure) to be inserted into a corresponding feed hole and the formation position of the mark Mk. Accordingly, even when the distance A does not satisfy the standard, the distance C between the center position of each feed hole and the mark Mk does not change. Note that the position change of the first sensor S1 based on the deviation of the feed holes is made before processing of tracking the mark Mk (to be described later in detail).

In addition, if the distance A of the pin-feed continuous paper P is confirmed to satisfy the JIS standard, or if the operator measures the distance d by using a scale and corrects the distance L in advance, the position change of the first sensor S1 based on the deviation amount of the feed holes may be skipped.

Next, processing performed by the controller 420 to change the position of the first sensor S1 is described.

Figure 6:
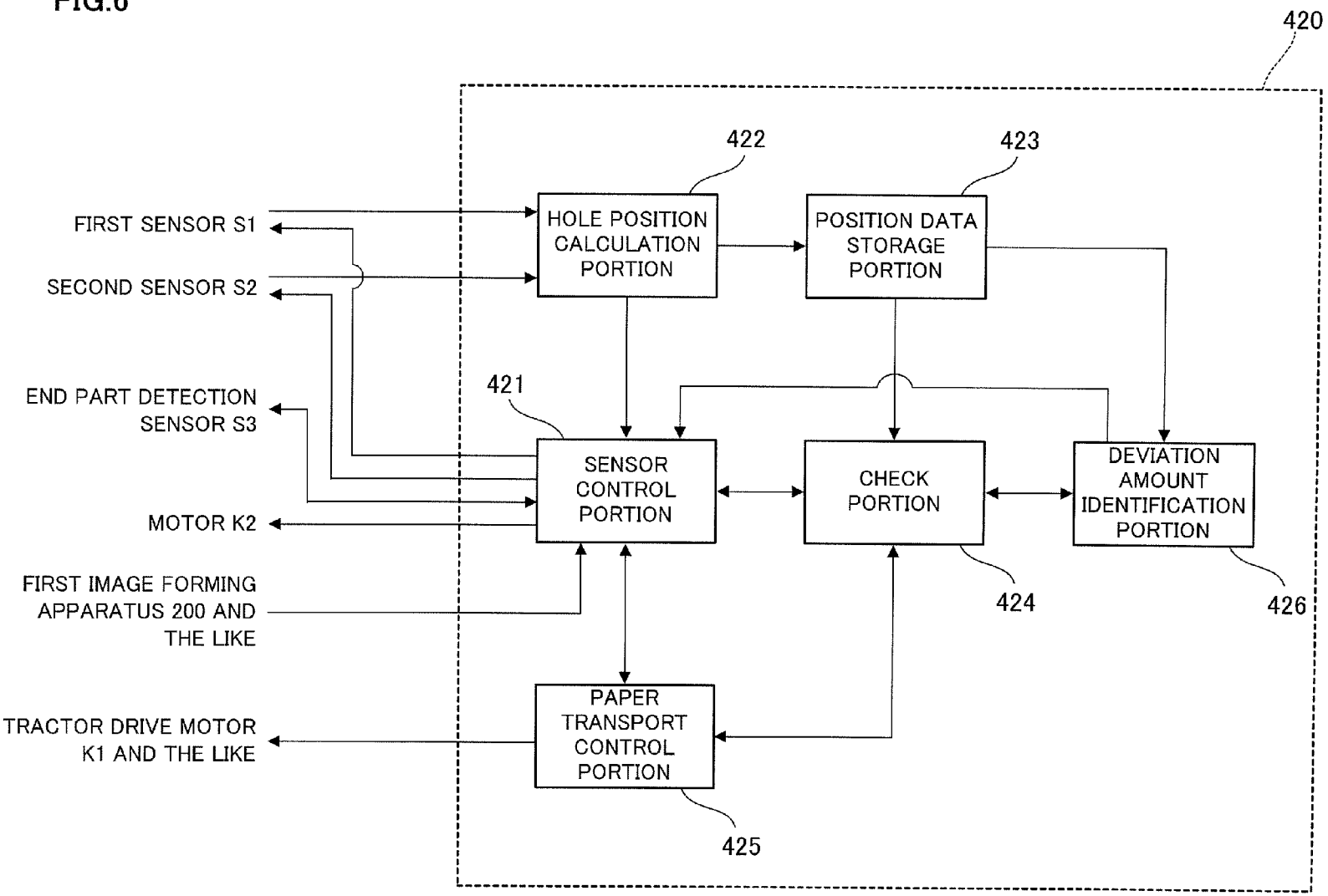
FIG. 6 is a diagram showing functional blocks for implementing functions for position change performed by the controller.

FIG. 6 is a diagram showing functional blocks for implementing functions for position change performed by the controller 420. The controller 420 of the first exemplary embodiment includes a sensor control portion 421, a hole position calculation portion 422, a position data storage portion 423, a check portion 424, a paper transport control portion 425 and a deviation amount identification portion 426. In the first exemplary embodiment, the hole position calculation portion 422 and the sensor control portion 421 function as an identification unit and an acquisition unit, respectively. The sensor control portion 421 functions as a disposition unit. The sensor control portion 421 and the deviation amount identification portion 426 function as a determination unit. Here, in practice, the controller 420 includes a central processing unit (CPU), a read only memory (ROM) and a random access memory (RAM). The CPU performs the processing while receiving and transmitting data from and to the RAM as needed in accordance with a program stored in the ROM, and thereby the above-described functions are implemented.

The sensor control portion 421 causes the motor K2 to drive, in order to move the end part detection sensor S3 in a corresponding fast scan direction, and then detects an output from the end part detection sensor S3. Further, the sensor control portion 421 causes the motor K2 to drive, in order to move the first sensor S1 and the second sensor S2 in a corresponding fast scan direction and then to stop the first sensor S1 and the second sensor S2 at predetermined positions. Furthermore, the sensor control portion 421 performs on and off control of the first sensor S1 and the second sensor S2. In addition, the sensor control portion 421 performs calculation (L+W/2) on the basis of the distance L and the width W notified by the first image forming apparatus 200 or a terminal device such as a PC, and thereby determines the destination positions of the first sensor S1 and the like, and further determines, by reflecting the deviation amount acquired from the deviation amount identification portion 426 in the determined destination position, a new destination position.

The hole position calculation portion 422 acquires output signals from the first sensor S1 and the second sensor S2, and then performs predetermined calculation on the basis of the output signals to obtain feed hole position data. Specifically, the hole position calculation portion 422 calculates the predetermined calculation on the basis of the output signals from the first sensor S1 and the second sensor S2, and then obtains the distance from the end part of the continuous paper P to the center position of each feed hole.

The position data storage portion 423 stores the position data obtained by the hole position calculation portion 422.

The check portion 424 checks whether or not the number of position data pieces stored in the position data storage portion 423 has reached a predetermined number, and also checks whether or not any position data piece is stored in the position data storage portion 423.

The paper transport control portion 425 causes the tractor drive motor K1 or the like to drive, in order to transport the continuous paper P. More specifically, the paper transport control portion 425 causes the tractor drive motor K1 or the like to drive, in order to move the continuous paper P forward or backward. In addition, the paper transport control portion 425 checks whether or not the transport distance of the continuous paper P has reached a predetermined distance.

The deviation amount identification portion 426 identifies a deviation amount of each feed hole in comparison with a standard value, on the basis of the position data stored in the position data storage portion 423, and then outputs the deviation amount to the sensor control portion 421.

Figure 7:
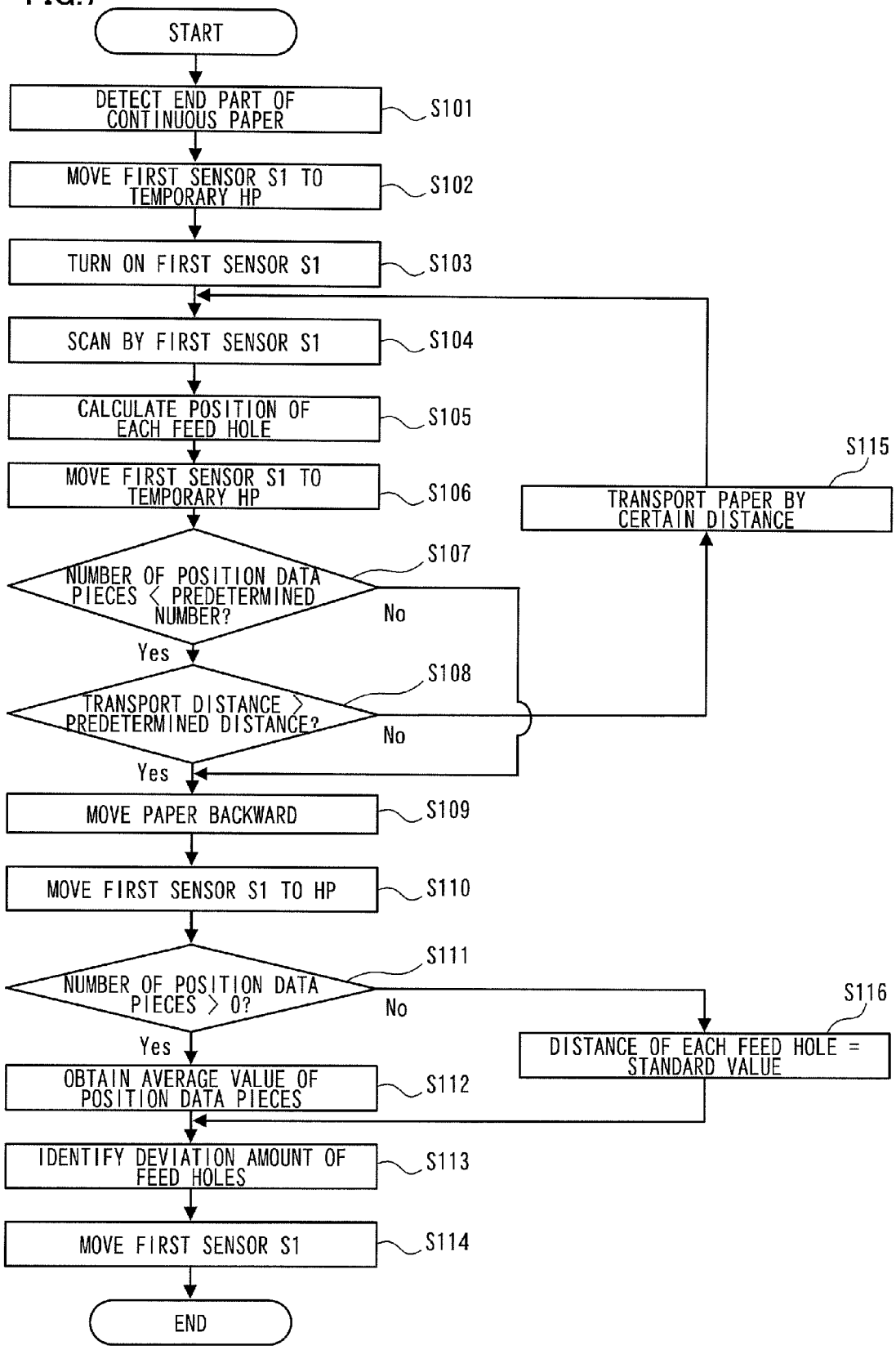
FIG. 7 is a flowchart showing the position change processing performed by the controller for changing the position of the first sensor.

FIG. 7 is a flowchart showing the position change processing performed by the controller 420 for changing the position of the first sensor S1. The position change processing is described below by using FIGS. 8A and 8B explaining operations of the first sensor S1 and the end part detection sensor S3.

In the position change processing in the first exemplary embodiment, firstly, the paper transport control portion 425 transports a predetermined amount of the continuous paper P so that the continuous paper P would reach a initial position in which the end part is detectable by the end part detection sensor S3. Then, the sensor control portion 421 causes the motor K2 to drive, in order to move the end part detection sensor S3 at the home position toward the continuous paper P, and then performs detection of the end part of the continuous paper P on the basis of a detection result by the end part detection sensor S3 (Step 101; Step is referred to as "S," below). It should be noted that, although the detection of the end part of the continuous paper P is performed by the end part detection sensor S3 as described above in the first exemplary embodiment, the first sensor S1 or the second sensor S2 may perform the end part detection, instead. In such a case, the end part detection sensor S3 may be omitted.

Subsequently, the sensor control portion 421 causes the motor K2 to drive in reverse, counts the number of steps, and moves the first sensor S1 to a position that is a predetermined distance (0.1 inch, for example) away from the end part of the continuous paper P (referred to as a "temporary home position (temporary HP)" below) (S102). Here, the temporary home position is set at a position that is closer to the end part of the continuous paper P than the home position side. Thereafter, the sensor control portion 421 turns on the first sensor S1 (S103). Then, the sensor control portion 421 causes the first sensor S1 to reciprocate in the width directions of the continuous paper P by using the temporary home position as a reference position. Specifically, the sensor control portion 421 causes the motor K2 to drive for a predetermined number of steps, to move the first sensor S1 by a predetermined distance (0.5 inch, for example) toward the continuous paper P. Thus, scan by the first sensor S1 is performed (S104).

Figure 8A:
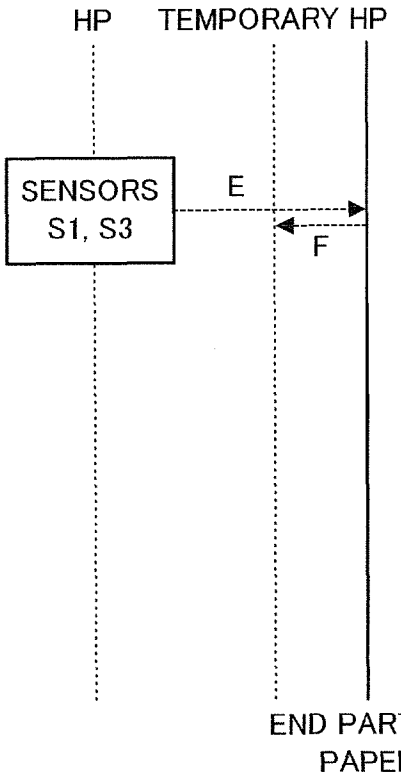
FIGS. 8A and 8B are views for explaining operations of the first sensor and the end part detection sensor.

The above-described operations are described below by using FIGS. 8A and 8B. The sensor control portion 421 moves the end part detection sensor S3 at the home position toward the continuous paper P as indicated by an arrow E in FIG. 8A, and thereby performs end part detection on the basis of a detection result by the end part detection sensor S3. Then, the sensor control portion 421 moves the first sensor S1 to the temporary home position as indicated by an arrow F. Thereafter, the sensor control portion 421 causes the motor K2 to drive for the predetermined number of steps, in order to move the first sensor S1 by a predetermined distance in the direction indicated by an arrow G in FIG. 8B (the inward direction of the continuous paper P).

Figure 9:
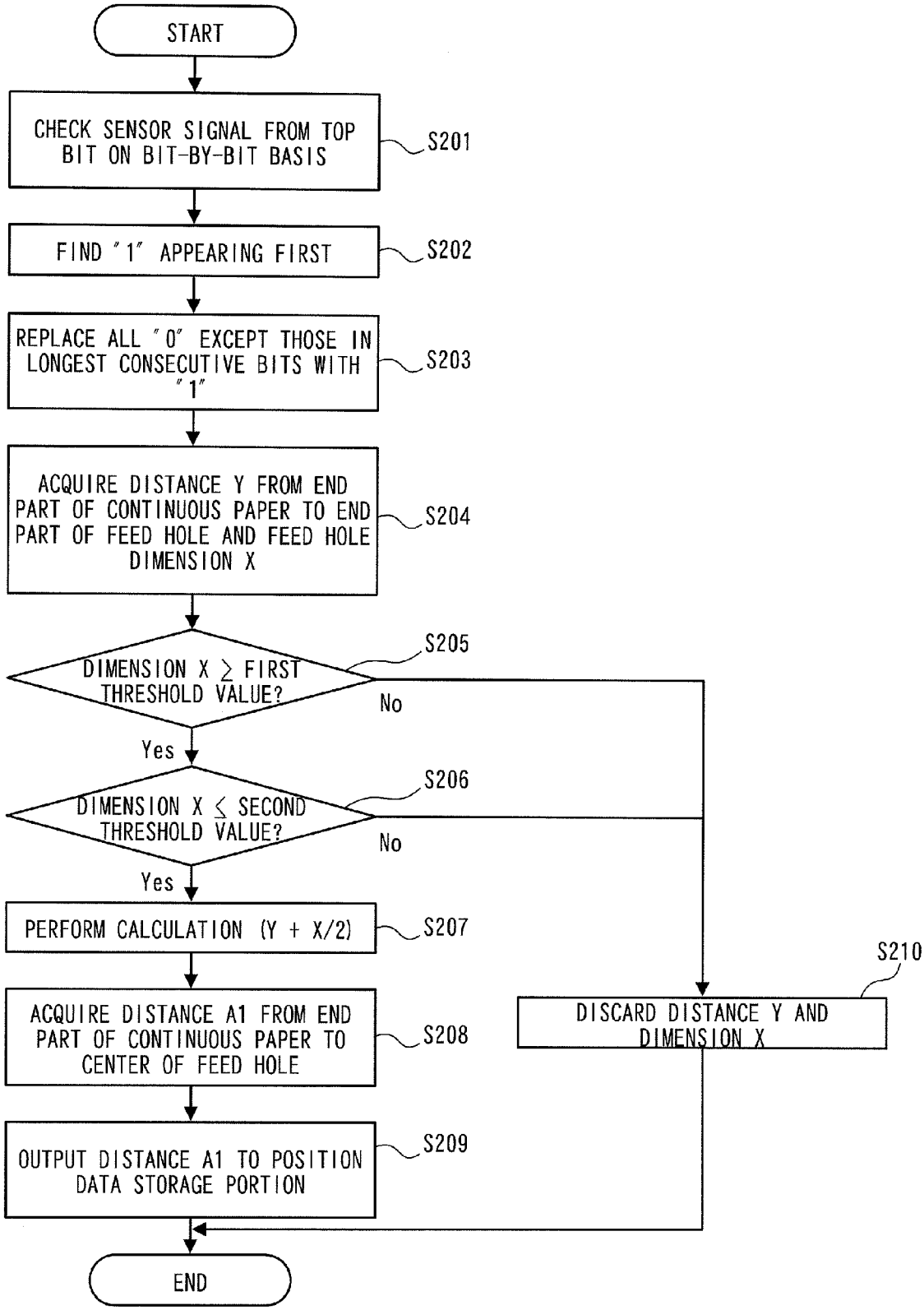
FIG. 9 is a flowchart of the calculation processing performed by the hole position calculation portion.
Figure 10A:
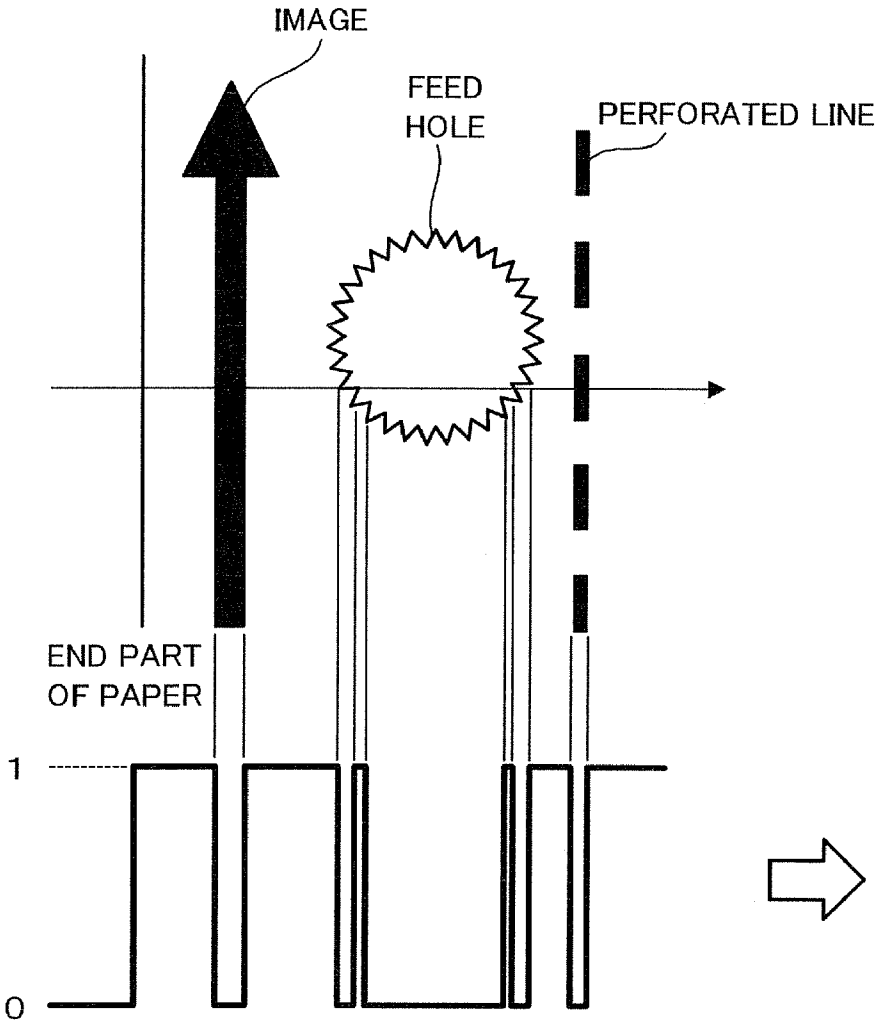
FIGS. 10A and 10B are diagrams showing an example of calculation performed by the hole position calculation portion.
Figure 10B:
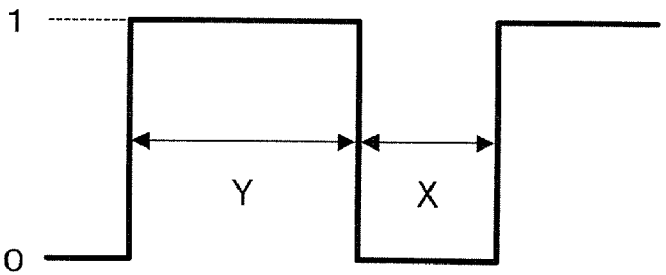

Subsequently, on the basis of a scan result by the first sensor S1, the hole position calculation portion 422 performs calculation processing for calculating the position of each feed hole (S105). The calculation processing performed in S105 is described below in detail by using FIG. 9 and FIGS. 10A and 10B. FIG. 9 is a flowchart of the calculation processing performed bathe hole position calculation portion 422, and FIGS. 10A and 10B are diagrams showing an example of calculation performed by the hole position calculation portion 422.

As shown in FIG. 9, the hole position calculation portion 422 checks an output signal consisting of "0" and "1" (i.e., a sensor signal or a binary signal) outputted from the first sensor S1, from the top bit of the signal on a bit-by-bit basis (S201), and finds "1" that appears first (S202). Then, the hole position calculation portion 422 replaces, with "1," all "0" except those included in the longest consecutive bits each represented by "0" (S203). Through this processing, the bits "0" attributable to an image formed on the continuous paper P beforehand or a perforated line are each replaced with "1," as shown in FIG. 10.

Subsequently, on the basis of the output signal after the replacement, the hole position calculation portion 422 acquires a distance Y from the end part of the continuous paper P to an end part of a feed hole (see FIG. 10B), and a feed hole dimension X (S204). Then, the hole position calculation portion 422 checks whether or not the feed hole dimension X is equal to or larger than a first threshold value (S205). When determining that the feed hole dimension X is equal to or larger than the first threshold value, the hole position calculation portion 422 further checks whether or not the feed hole dimension X is equal to or smaller than a second threshold value (the second threshold value>the first threshold value) (S206). When determining that the feed hole dimension X is equal to or smaller than the second threshold value, the hole position calculation portion 422 performs calculation (Y+X/2) (S207), and then acquires a distance A1 from the end part of the continuous paper P to the center of the feedhole (S208). Thereafter, the hole position calculation portion 422 outputs the distance A1 as position data to the position data storage portion 423 (S209), and the position data storage portion 423 stores the distance A1.

Here, when determining that the dimension X is smaller than the first threshold value in S205, the hole position calculation portion 422 discards the distance Y and the dimension X (S210), and does not acquire the distance A1. When the feed hole dimension X is smaller than the first threshold value, assumed is a case in which the detection position of the first sensor S1 passes near the end part of the feed hole, and in which the edge of the feed hole is detected a multiple number of times, for example. In such a case, the dimension X is considered to be obtained in a situation where the output signal includes gaps, and may thus be inaccurate.

Also when determining that the feed hole dimension X is larger than the second threshold value in S206, that is, when the dimension X exceeds the second threshold value, the hole position calculation portion 422 discards the distance Y and the dimension X (S210), due to the following reasons. The feed hole may be enlarged ununiformly while the continuous paper P is transported by the first tractor T1 to the third tractor T3 of the first image forming apparatus 200, for example, and, in such a case, an obtained dimension X is likely to be that of the ununiformly enlarged feed hole. Moreover, in some cases, holes, for example, for a binder, that are larger than the feed hole may be formed in the continuous paper P in addition to the feed holes, and such a larger hole may possibly be detected, instead.

The position change processing for changing the position of the first sensor S1 is further described below with reference to FIG. 7 again.

Figure 8B:
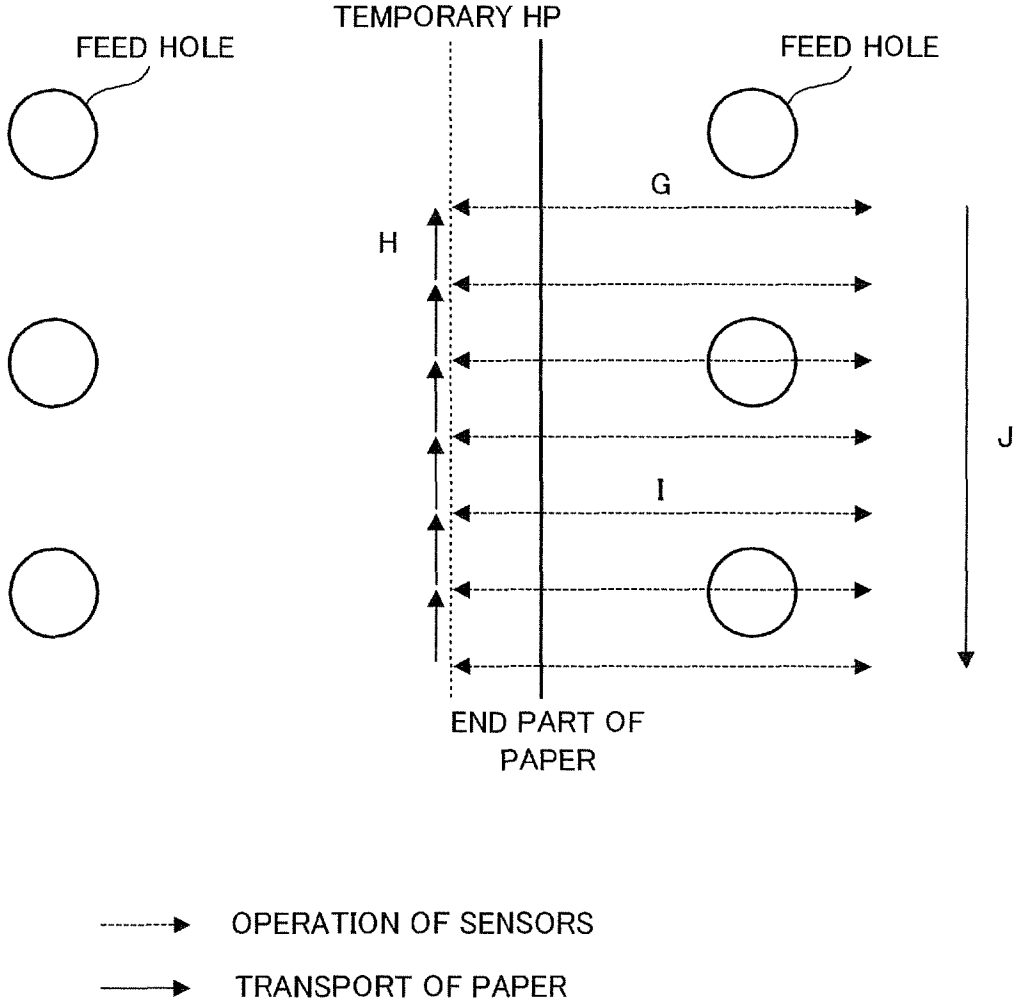

After the calculation processing by the hole position calculation portion 422, the sensor control portion 421 causes the motor K2 to drive, in order to move the first sensor S1 to the temporary home position as indicated by the arrow G in FIG. 8B (S106). Then, the check portion 424 reads out the position data pieces (the distances A1) from the position data storage portion 423 to check whether or not the number of the position data pieces has reached a predetermined number, more specifically, whether or not the number of the position data pieces is smaller than the predetermined number (S107). When the check portion 424 determines that the number of the data pieces is smaller than the predetermined number, the paper transport control portion 425 checks whether or not the transport distance of the continuous paper P from the initial position is larger than a predetermined distance (3.5 inches, for example) (S108). When determining that the transport distance is larger than the predetermined distance in S108, the paper transport control portion 425 causes the tractor drive motor K1 or the like to drive, in order to move the continuous paper P backward as indicated by an arrow J in FIG. 8B (S109), so that the continuous paper P returns to the initial position.

Also when the check portion 424 determines that the number of the position data pieces is equal to or larger than the predetermined number in S107, that is, when the number of the data pieces has reached the predetermined number, the paper transport control portion 425 moves the continuous paper P backward (S109).

By contrast, when determining that the transport distance of the continuous paper P from the initial position is equal to or smaller than the predetermined distance in S108, that is, the transport distance of the continuous paper P has not reached the predetermined distance, the paper transport control portion 425 causes the tractor drive motor K1 or the like to drive for a predetermined amount, in order to transport (move forward) the continuous paper P by a certain distance (⅙ inch, for example) (S115). Thereafter, the processing from S104 to S107 is performed again. When the number of the position data pieces is smaller than the predetermined number while the transport distance of the continuous paper P from the initial position is smaller than the predetermined distance, as a result of the processing, the continuous paper P is transported by a predetermined distance as indicated by arrows H in FIG. 8B, and the first sensor S1 performs scanning as indicated by arrows I in FIG. 8B.

In the first exemplary embodiment, the end part of the continuous paper P is detected in S101. Accordingly, another possibility is to place, by using this information, the first sensor S1 in such a position that the detection position of the first sensor S1 would correspond to this end part, for example, and to perform scanning from the position. In other words, the feed hole detection reference position may be fixed, and, in such a case, scanning is performed from the fixed detection position. Then, on the basis of an output signal from the first sensor S1, a distance Y2 to the feed hole and the feed hole dimension X are obtained, and, by performing calculation (Y2+X/2), the distance A1 is obtained.

In a part where the mark detection mechanism 470 (see FIG. 1) is provided, no positioning for the continuous paper P is performed by the first tractor T1 or the like. For this reason, in S115, the continuous paper P may be transported in the state of deviating from the appropriate position in the fast scan directions. In addition, when the distances A1 are obtained again in S105 after the transport, the distances Y2 may possibly include the deviation amount of the continuous paper P. As a result, a larger value than the actual value may be detected as each of the distances A1, for example. In view of such a possibility, in the first exemplary embodiment, the starting point of the distance Y for the calculation of the distance A1 is set to be the end part position (detected (obtained) end part position) of the continuous paper P as described above.

A larger number of times to transport the continuous paper P and then to scan the continuous paper P by the first sensor S1 results in acquiring a larger number of position data pieces. However, as the transport and scanning are performed a larger number of times, it is more likely that toner transferred onto the continuous paper P by the transfer unit moves on the transport path along with the transport of the continuous paper P, and adheres to members on the transport path. Moreover, in the first exemplary embodiment, when detecting sag of the continuous paper P, the winding-up apparatus 500 automatically winds up the continuous paper P. For these reasons, if the second image forming apparatus 400 is allowed to transport the continuous paper P without limit, the continuous paper P is wound up by the winding-up apparatus 500, which makes it difficult for the continuous paper P to move backward. Accordingly, in the first exemplary embodiment, when the transport distance of the continuous paper P exceeds the predetermined distance, the continuous paper P is not moved forward any further.

The description is further continued below with reference to FIG. 7. After S109, the sensor control portion 421 causes the motor K2 to drive, in order to move the first sensor S1 to the home position (S110). Here, the sensor control portion 421 sets the first sensor S1 to be in an off state. Thereafter, the check portion 424 reads out position data pieces from the position data storage portion 423, and checks whether or not the number of the position data pieces is larger than 0 (zero) (S111). In other words, after reading out position data pieces from the position data storage portion 423, the check portion 424 checks whether or not there is any position data piece. When the number of data pieces is larger than 0 (zero), the deviation amount identification portion 426 obtains the average value of the position data pieces (distances A1) (S112).

Subsequently, the deviation amount identification portion 426 obtains, from a memory such as the ROM, the standard value from the end part of the continuous paper P to the center of each feed hole (for example, 6 mm, see A in FIG. 4), and then performs calculation (average value of distances A1—standard value) to identify the deviation amount of the feed holes with respect to the standard value (S113). Then, the sensor control portion 421 adds the deviation amount to the distance LM (see FIG. 5B) to determine the placement position of the first sensor S1, and then causes the motor K2 to drive, in order to move the first sensor S1 from the home position to the placement position (S114).

When the check portion 424 determines that the number of the position data pieces is equal to 0 (zero) in S111, that is, when no position data piece exists, the deviation amount identification portion 426 identifies, as the standard value, the distance from the end part of the continuous paper P to the center of each feed hole (feed hole position) (S116). In this case, the feed hole deviation amount is identified to be 0 (zero) in S113, and the first sensor S1 is thus moved to the position satisfying the distance LM in S114. Here, in the first exemplary embodiment, when image forming operation is started, the controller 420 detects that the mark Mk is not detected, and a display of "mark is not detected," for example, is presented by using the UI 480 or the like. Then, the operator adjusts the position of the first sensor S1, and successful detection of the mark Mk is consequently performed. Alternatively, when the check portion 424 determines that the number of the position data pieces is equal to 0 (zero) in S111, the controller 420 may determine to perform the processing from S101 again, instead.

FIGS. 11A to 11D are views for explaining a scanning region of the first sensor S1.

Although the detailed description has been omitted above, the scanning region of the first sensor S1 is set to be (limited to) a predetermined range in the first exemplary embodiment. More specifically, the scanning region of the first sensor S1 is set so that the scanning amount of the first sensor S1 in the image forming region of the continuous paper P would be set smaller than the first threshold value. As described above, in the first exemplary embodiment, the feed hole dimension X and the like are obtained on the basis of an output signal from the first sensor S1. In some cases, when the detection position of the first sensor S1 passes an image, this image may be mistakenly identified as a feed hole.

For example, as shown in FIG. 11A, when the detection position of the first sensor S1 includes an image, an output signal shown in FIG. 11B may possibly be obtained, indicating that the image is identified as a feed hole. For this reason, in the first exemplary embodiment, the scanning amount of the first sensor S1 in the image forming region is set to be smaller than the first threshold value, as shown in FIG. 11C. Although, even in this case, the image affects the output signal of the first sensor S1 as shown in FIG. 11D, the distance X attributable to the image is smaller than the first threshold value. Accordingly, the distance X is discarded in S210.

Next, a method of tracking the mark Mk is described below.

Figure 12:
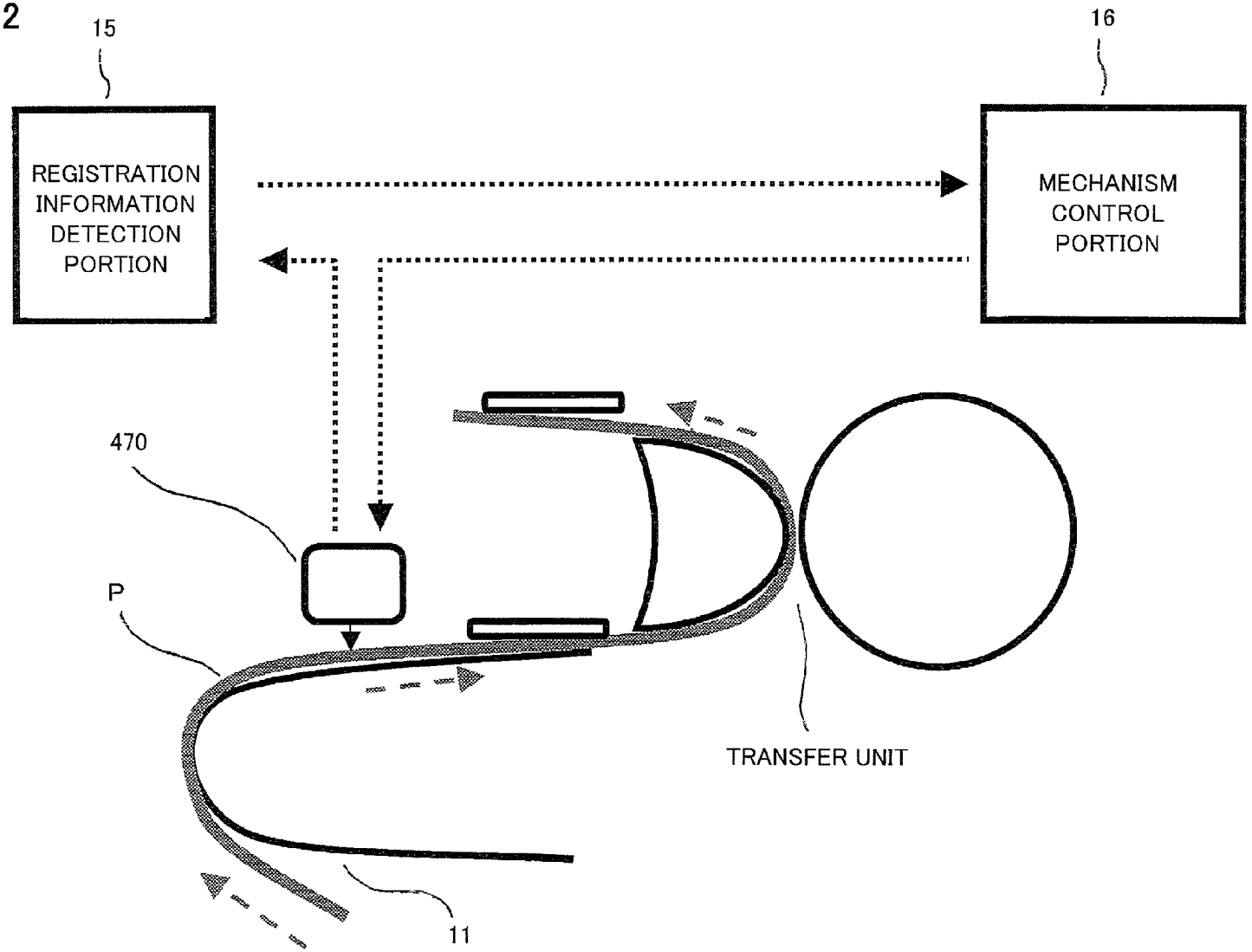
FIG. 12 is a diagram for explaining a configuration example of essential portions of the image forming apparatus according to the present invention.
Figure 13B:
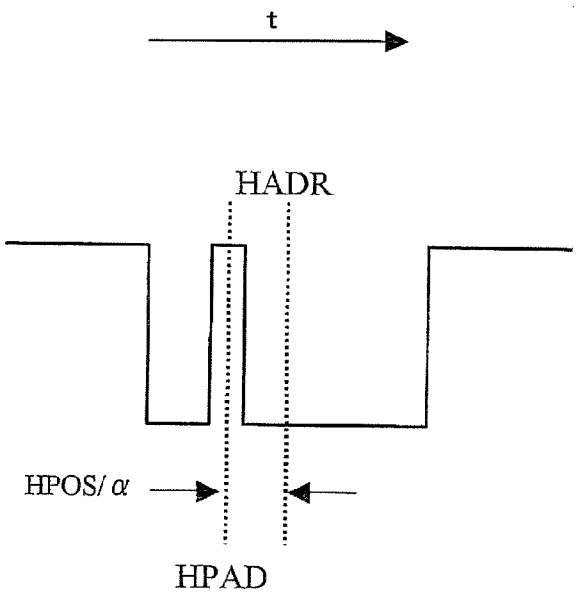
FIGS. 13A and 13B are diagrams for explaining configuration examples of essential portions of the image forming apparatus according to the present invention.
Figure 13A:
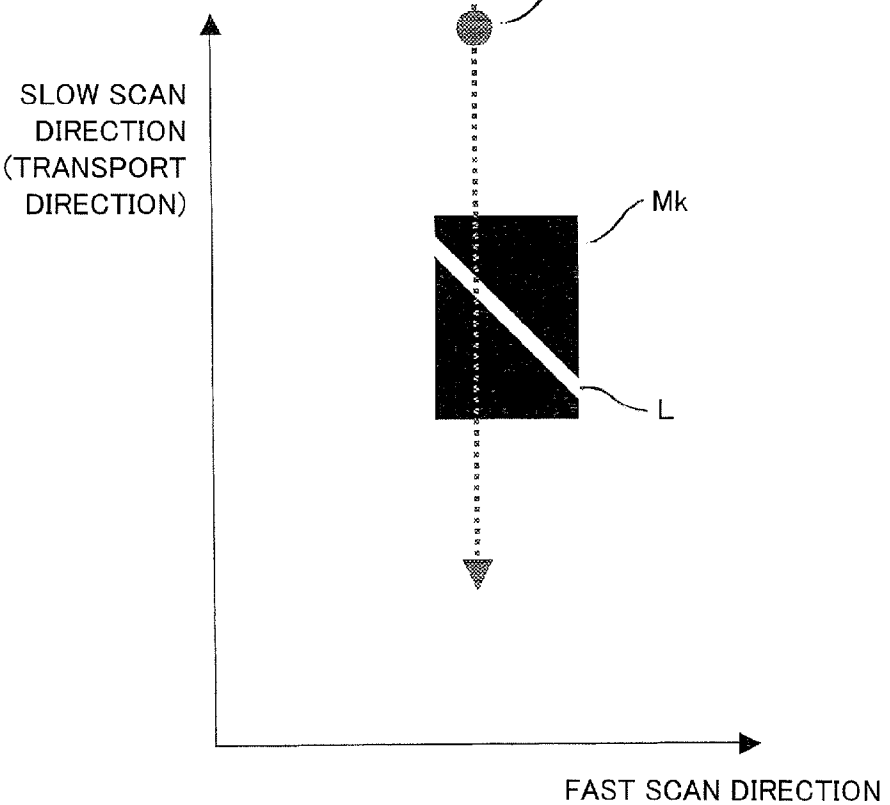
Figure 14:
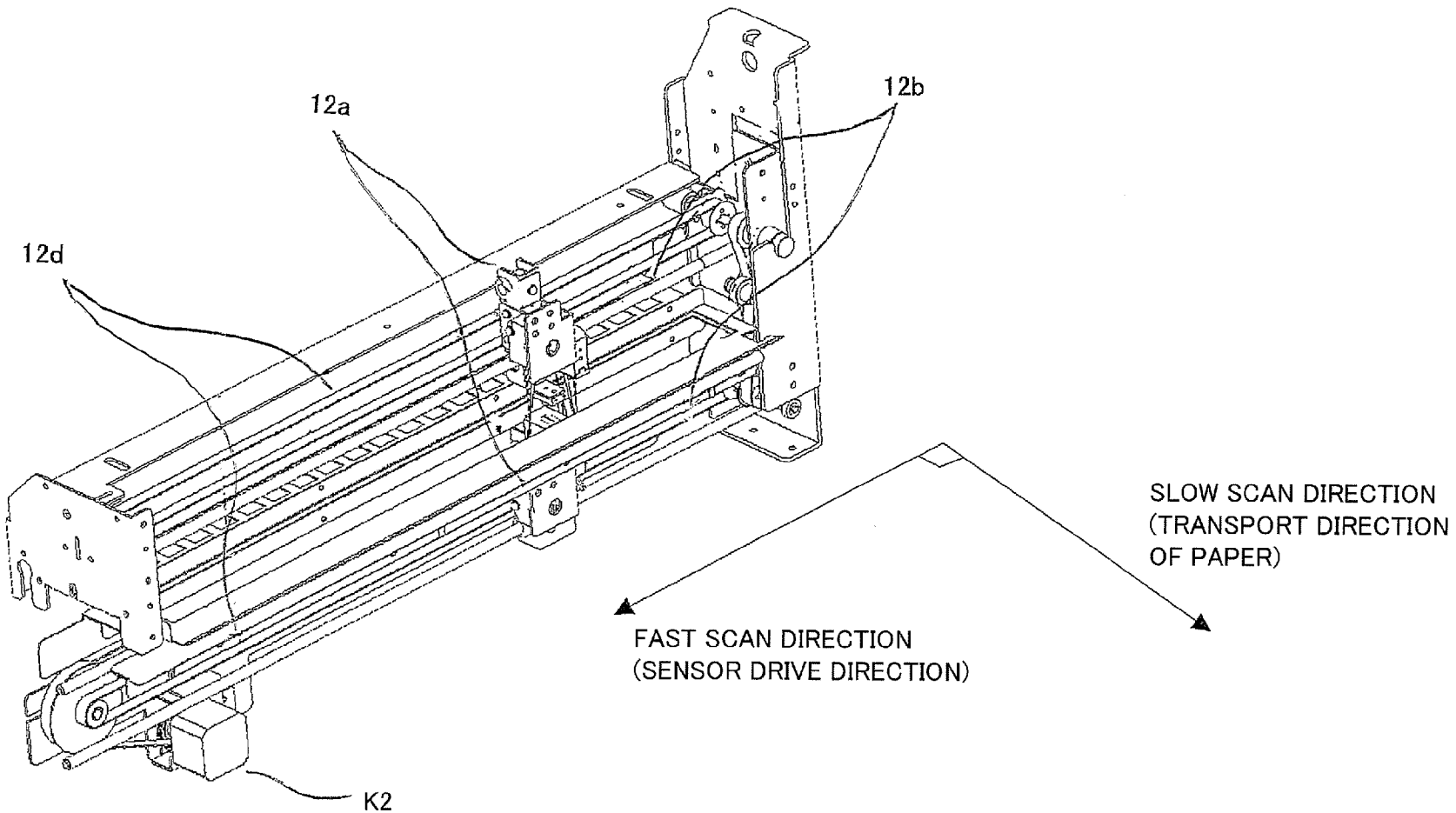
FIG. 14 is a diagram for explaining a configuration example of essential portions of the image forming apparatus according to the present invention.

FIGS. 12 to 14 are diagrams for explaining configuration examples of essential portions of the image forming apparatus according to the present invention.

The mark detection mechanism 470 detects the mark Mk on the continuous paper P with a detection effective range that is smaller than the dimension of the mark Mk in the fast scan directions.

Specifically, as shown in FIG. 13A, one possibility is to irradiate the continuous paper P with a beam spot B having a diameter smaller than the dimension of the mark Mk in the fast scan directions (orthogonal directions to the transport direction), and thereby detect the mark Mk by using the first sensor S1 having a detection effective range corresponding to the irradiation range of the beam spot B. Here, an optical sensor, a reflection type or a transmission type, may be used as the first sensor S1. However, the first sensor S1 is not limited to an optical sensor. As long as being capable of detecting the mark Mk and having a detection effective range that is smaller than the dimension of the mark Mk, any other known sensor may be used for the detection.

The mark Mk, which is a detection target, includes a part having a shape that uniquely specifies a relative positional relationship between the mark Mk and the beam spot B in the fast scan directions on the basis of the detection timing, although the description of this part is omitted above. An example of such a part is an oblique line part L included in the mark Mk shown in FIG. 13A.

As described above, the mark detection mechanism 470 has a configuration in which the first sensor S1 (sensor) to perform detection of the mark Mk is allowed to move in the fast scan directions (the orthogonal directions to the transport direction).

Specifically, as shown in FIG. 14, a sensor unit 12*a* on which the first sensor S1, which is a sensor, is mounted is supported by rails 12*b* extending in the fast scan directions (sensor drive direction), so as to be capable of moving in the fast scan directions. To the sensor unit 12*a*, drive belts 12*d* driven by the motor K2 (see FIG. 3) are coupled. With this configuration, in the mark detection mechanism 470, the sensor unit 12*a* moves an amount corresponding to the drive of the motor K2, in a corresponding fast scan direction.

As shown in FIG. 12, to the mark detection mechanism 470, a registration information detection portion 15 and a mechanism control portion 16 provided in the controller 420 (see FIG. 1) are electrically connected. The registration information detection portion 15 serves as a positional relationship identification unit, and the mechanism control portion 16 serves as a move unit.

The registration information detection portion 15 receives a signal indicating a detection result of the mark Mk from the mark detection mechanism 470, and then specifies a relative positional relationship between the sensor (first sensor S1) of the mark detection mechanism 470 and the mark Mk, which is a detection target of the sensor, by calculation processing based on the received signal. More specifically, the registration information detection portion 15 specifies, as the relative positional relationship, a deviation amount between the center position of the detection effective range of the sensor of the mark detection mechanism 470 in the fast scan direction and the center position of the mark Mk formed on the continuous paper P in the fast scan direction.

The mechanism control portion 16 instructs the mark detection mechanism 470 to move the position of the sensor of the mark detection mechanism 470 in a corresponding fast scan direction, on the basis of the relative positional relationship specified by the registration information detection portion 15. More specifically, the mechanism control portion 16 instructs the motor K2 of the mark detection mechanism 470 to drive, in order to align the center position of the detection effective range of the sensor of the mark detection mechanism 470 in the fast scan direction and the center position of the mark Mk formed on the continuous paper P in the fast scan direction. Thereby, the position of the sensor unit 12*a* in the mark detection mechanism 470 is moved.

Note that the registration information detection portion 15 and the mechanism control portion 16 are each considered to be implemented by a combination of a central processing unit (CPU) for executing a predetermined program and a storage device or the like for storing the predetermined program. In other words, the registration information detection portion 15 and the mechanism control portion 16 are each considered to be implemented by using a function as a computer.

Each of the first image forming apparatus 200 and the second image forming apparatus 400 with the above-described essential portions, excluding component portions for image formation such as the transfer unit and the fixing unit, forms a medium transport apparatus according to the present invention.

Next, an example of processing operations of an image forming apparatus (medium transport apparatus) having the above-described configuration is described below.

For example, in the second image forming apparatus 400 (medium transport apparatus), the first sensor S1, which is a sensor mounted on the sensor unit 12*a* of the mark detection mechanism 470, reads the mark Mk including the oblique line part L as the one shown in FIG. 13A, from the surface of the continuous paper P transported on a transport path 11 (see FIG. 12). In this event, the sensor unit 12*a* is assumed to be placed in a position, in the fast scan directions, which allows the reading of the mark Mk thus transported, that is, a position which allows the detection effective range of the first sensor S1 of the sensor unit 12*a* to be within the formation range of the mark Mk in the fast scan directions.

When reading the mark Mk, the first sensor S1 of the sensor unit 12*a* outputs a signal having a waveform as shown in FIG. 13B, for example.

Then, when receiving the signal having a waveform as shown in FIG. 13B from the mark detection mechanism 470, the registration information detection portion 15 calculates a center position HADR of the read mark Mk in slow scan directions, from edge information pieces (a rising edge information piece and a falling edge information piece). Further, the registration information detection portion 15 calculates a center position HPAD of the oblique line part L in the slow scan directions, from edge information pieces (a rising edge information piece and a falling edge information piece). Thereafter, the registration information detection portion 15 uses these calculation results and a predetermined equation "$HPOS=\alpha(HADR-HPAD)$" (where $\alpha$ is a coefficient specified on the basis of the oblique angle of the oblique line part L, and converts the relative positional relationship in the slow scan directions to that in the fast scan directions), to identify a deviation amount HPOS between the center position of the detection effective range of the first sensor S1 in the fast scan direction and the center position of the mark Mk read by the first sensor S1 in the fast scan direction.

After the deviation amount HPOS between the center positions, in the fast scan direction, of the first sensor S1 of the mark detection mechanism 470 and of the mark Mk read by the first sensor, is specified as the relative positional relationship as described above, the registration information detection portion 15 and the mechanism control portion 16 perform control processing having the following sequence.

Figure 15:
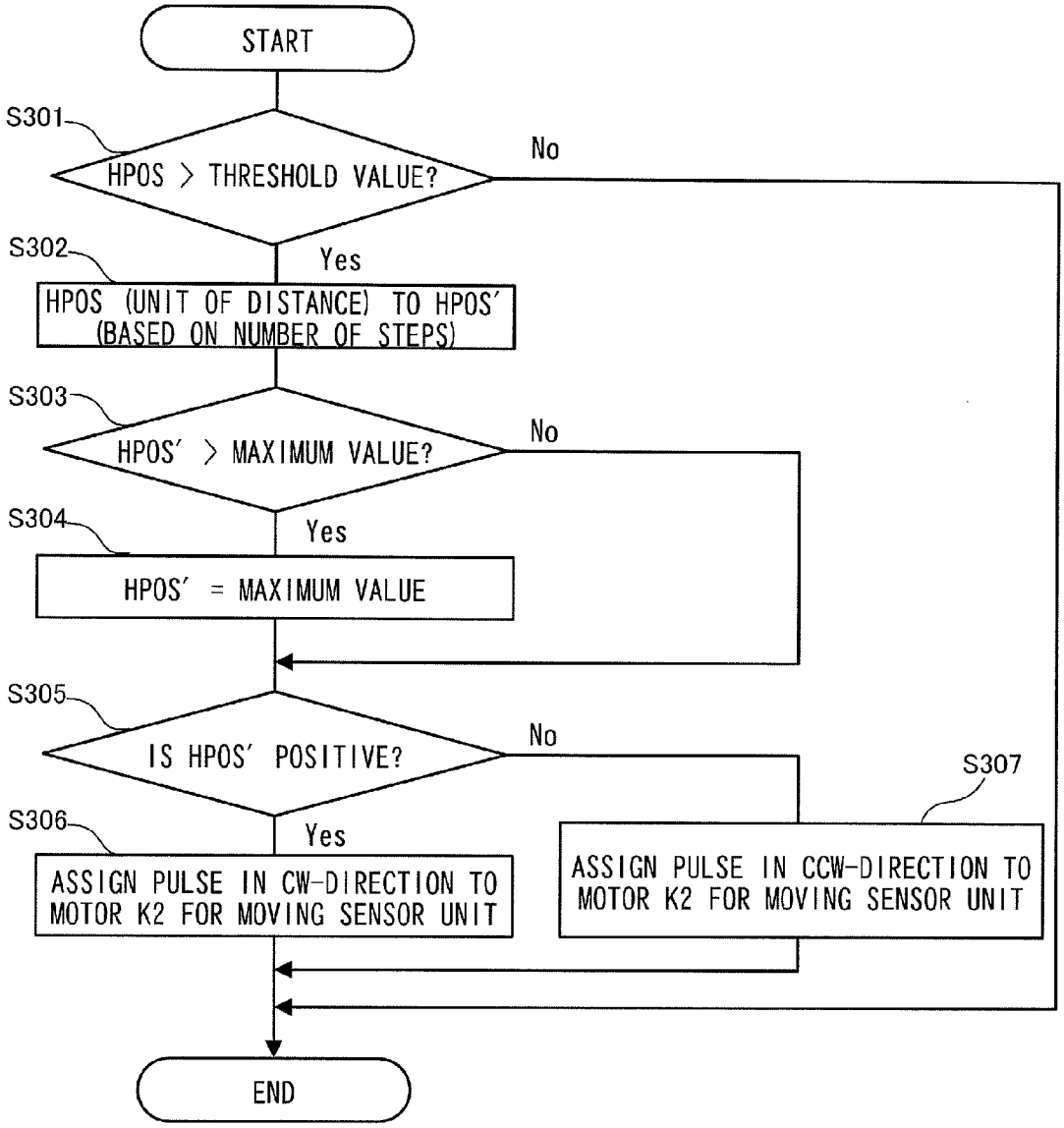
FIG. 15 is a flowchart showing a concrete example of a control processing procedure performed by the image forming apparatus according to the present invention.

FIG. 15 is a flowchart showing a concrete example of a control processing procedure performed by the image forming apparatus according to the present invention.

As shown in FIG. 15, after the identification of the deviation amount HPOS, first, the registration information detection portion 15 compares the identified deviation amount HPOS with a predetermined threshold value, to check whether the deviation amount HPOS is larger than the predetermined threshold value (S301). This predetermined threshold value may be set in advance, on the basis of an empirical rule such as an experiment result from a view point of whether or not the deviation amount HPOS is so large that the sensor unit 12*a* would need to be moved, that is, whether or not the deviation amount HPOS is so large as to affect detection of the mark Mk badly, and also in consideration of the performance (detection resolution, for example) of the first sensor S1 in order to eliminate influence of false detection by the first sensor S1. Specifically, the predetermined threshold value is considered to be set at 0.2 mm in absolute value, for example.

As a result of this check, if the deviation amount HPOS is equal to or smaller than the predetermined threshold value, this indicates that the deviation amount HPOS is not so large as to affect detection of the mark Mk badly. Thus, it is considered that the sensor unit 12*a* does not need to be moved in the fast scan directions, and the control processing for moving the sensor unit 12*a* is terminated without doing anything further.

If the deviation amount HPOS is larger than the predetermined threshold value, it is considered that the sensor unit 12*a* needs to be moved in a corresponding fast scan direction. Accordingly, the control processing for moving the sensor unit 12*a* is not terminated, but is continued, instead. Then, the registration information detection portion 15 converts the value of the identified deviation amount HPOS with a unit of distance in the fast scan directions, into a value corresponding to a drive amount of the motor K2 of the mark detection mechanism 470, more specifically, an amount HPOS' identified on the basis of the number of steps of the motor K2 (S302). The conversion result is set to be the correction amount HPOS' for the motor K2 for aligning the sensor unit 12*a* with the mark Mk.

After converting the deviation amount HPOS into the correction amount HPOS', the registration information detection portion 15 compares the correction amount HPOS' obtained from the conversion, with a predetermined maximum value, in order to check whether or not the correction amount HPOS' is larger than the predetermined maximum value (S303). This predetermined maximum value may be set in advance, from the view point of whether or not the moving of the sensor unit 12*a* completes before the reading of the next one among marks Mk disposed at certain intervals on the continuous paper P, on the basis of mark position intervals, apparatus throughput and the like.

Here, the predetermined maximum value to be compared with the correction amount HPOS' is described below further in detail.

Figure 16:
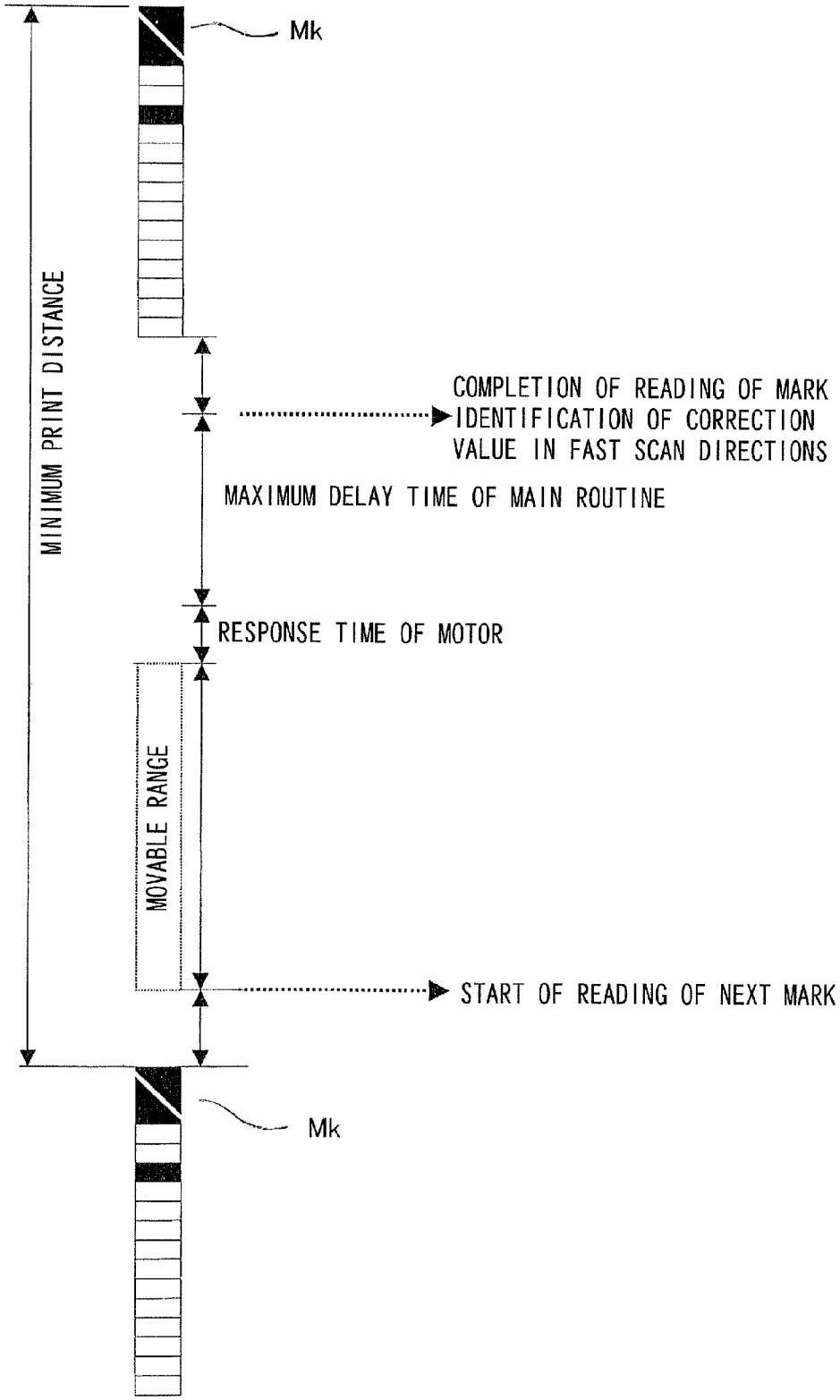
FIG. 16 is a view for explaining a concrete example of a setting concept of the predetermined maximum value.

FIG. 16 is a view for explaining a concrete example of a setting concept of the predetermined maximum value.

As in the example shown in FIG. 16, since multiple marks Mk are provided at predetermined intervals in the transport direction (slow scan direction) of the continuous paper P, on the continuous paper P, the first sensor S1 of the mark detection mechanism 470 reads the mark Mk periodically. In other words, the first sensor S1 performs the reading of the mark Mk, at intervals (see "minimum print distance" in FIG. 16) identified on the basis of the transport speed of the continuous paper P and the intervals of the positions of the marks Mk on the continuous paper P.

Thus, the maximum time usable for the moving of the sensor unit 12*a* between the reading of a certain mark Mk and the reading of the next mark Mk (see "movable range" in FIG. 16) is uniquely identified in consideration of, for example: the timing at which, after completing the reading of the certain mark Mk, a correction value of a position deviation in the fast scan directions based on the reading result is identified; the maximum delay time of the processing main routine of each of the registration information detection portion 15, the mechanism control portion 16 and the like; the response time of the motor K2 of the mark detection mechanism 470; and the timing of starting the reading of the next mark Mk.

Accordingly, the predetermined maximum value may be set by obtaining a limit value of the sensor unit 12*a* capable of moving in the movable range, in consideration of the operation speed of the motor K2 and the like. In short, the maximum move amount of the sensor unit 12*a* capable of moving in the movable range is set to be the predetermined maximum value.

As a result of comparison with the predetermined maximum value, if the correction amount HPOS' is larger than the predetermined maximum value, the registration information detection portion 15 replaces the value of the correction amount HPOS' with the predetermined maximum value as shown in FIG. 15 (S304). By contrast, if the correction amount HPOS' is not larger than the predetermined maximum value, the registration information detection portion 15 uses the value of the correction amount HPOS' without replacing the value with the predetermined maximum value.

After identifying the correction amount HPOS' through the above-described procedure, the registration information detection portion 15 notifies the mechanism control portion 16 of the identified correction amount HPOS'.

When receiving the notification of the correction amount HPOS', the mechanism control portion 16 checks whether or not the notified amount HPOS' is a positive value (S305).

If determining that the correction amount HPOS' is a positive value, the mechanism control portion 16 assigns an operation pulse in the CW-direction (the clockwise direction when seen from an output axis side, i.e., the normal rotation direction) to the motor K2 for moving the sensor unit 12*a*, in order to cause the motor K2 to operate for the correction amount HPOS', thereby moving the sensor unit 12*a* (S306).

On the other hand, if determining that the correction amount HPOS' is not a positive value, the mechanism control portion 16 assigns an operation pulse in the CCW direction (the counter-clockwise direction when seen from the output axis side, i.e., the reverse rotation direction) to the motor K2 for moving the sensor unit 12*a*, in order to cause the motor K2 to operate for the correction amount HPOS', thereby moving the sensor unit 12*a* (S307).

In this event, if replacement of the correction amount HPOS' with the predetermined maximum value has been performed, which sets the predetermined maximum value to be the move amount of the sensor unit 12*a*, the sensor unit 12*a* is not caused to move beyond the predetermined maximum value.

Through the above-described procedure of the control processing, the position of the mark Mk in the fast scan direction and the position of the first sensor S1 of the mark detection mechanism 470 detecting the position of the mark Mk in the fast scan direction are identified. Thereby, the sensor unit 12*a* on which the first sensor S1 is mounted is moved for the amount corresponding to the deviation amount between the identified positions. Consequently, before the detection of the next mark Mk, the deviation between the positions of the mark Mk and the first sensor S1 is corrected. For this reason, even when the detection effective range of the first sensor S1 is smaller than the dimension of the mark Mk, the sensor unit 12*a* is guided so that the detection effective range would correspond to the formation position of the mark Mk, in order to cause the first sensor S1 to track the formation position of the mark Mk. Thus, deviation of the mark Mk from the detection effective range of the first sensor S1 is prevented.

Figure 17A:
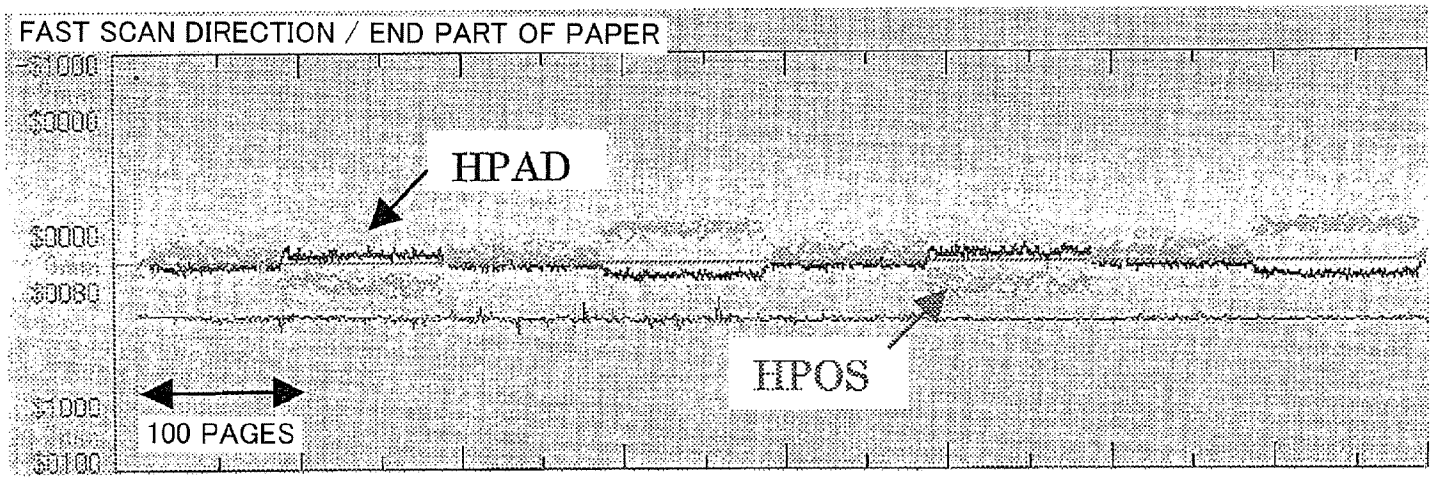
FIGS. 17A and 17B are graphs showing a concrete example of a result of the mark tracking control processing.
Figure 17B:
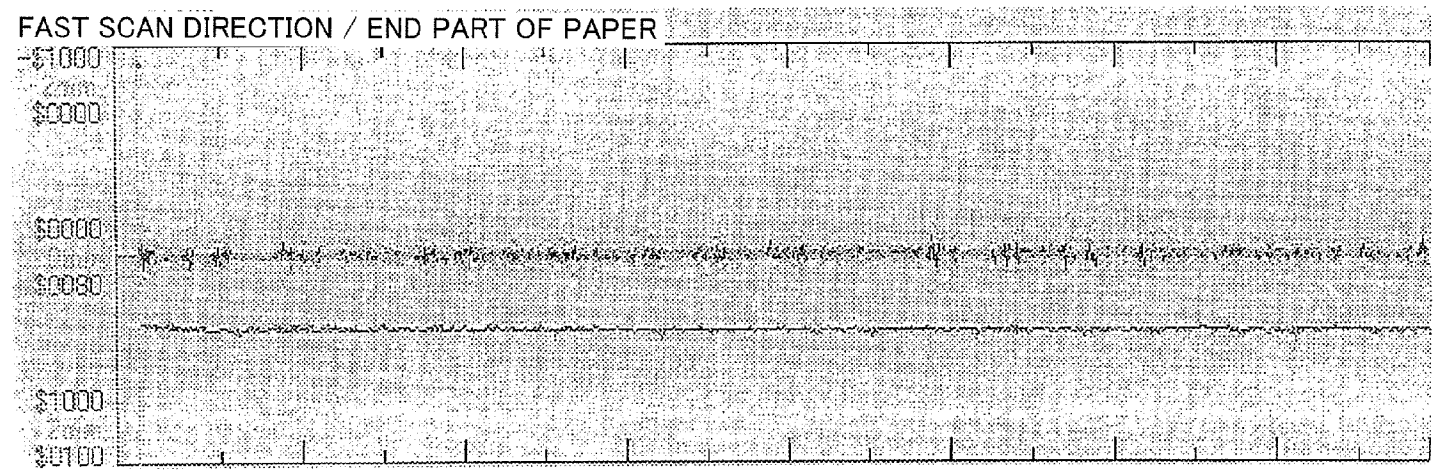

FIGS. 17A and 17B are graphs showing a concrete example of a result of the mark tracking control processing.

FIG. 17A shows a concrete example of the deviation amounts HPOS before execution of the mark tracking control processing, and FIG. 17B shows a concrete example of the deviation amounts HPOS after execution of the mark tracking control processing.

It is obvious from FIGS. 17A and 17B that the positional deviation between the first sensor S1 of the sensor unit 12*a* and the marks Mk on the continuous paper P is corrected when the tracking control processing of the marks Mk in the above-described procedure is performed, compared to the case of not performing the tracking control processing. Thus the deviation amounts HPOS are cancelled.

In the case where the tracking control processing in the above-described procedure is not performed, even if the deviation amount HPOS occurring for each mark Mk is small, the deviation amounts HPOS are supposed to be accumulated due to the marks Mk provided at the certain intervals on the continuous paper P, and the marks Mk on the continuous paper P may consequently be deviated from the detection effective range of the first sensor S1. However, the tracking control processing in the above-described procedure successfully avoids the situation where the marks Mk deviate from the detection effective range of the first sensor S1.

Next, another concrete example of the mark tracking control processing is described.

In another concrete example, information on the accumulated move amount of the sensor unit 12*a* or information on move history of the sensor unit 12*a* is used.

Here, the "information on the accumulated move amount" is an accumulated value of the move amounts from the start of the control processing, that is, the accumulated value of the correction amounts HPOS' calculated in consideration of the sign, which is either plus or minus, of each correction amount.

The "information on move history" is information that specifies the move history of the sensor unit 12*a*. Specifically, this information includes information on the history of identified results of the deviation amounts HPOS and information on the history of identified correction amounts HPOS'.

The above information may be stored in a predetermined storage area accessible by the registration information detection portion 15. In other words, if the information on the accumulated amount or the information on move history is to be used, the image forming apparatus needs to have a function as a memory storing the information. Here, the storage unit may be any storage as long as it is accessible by the registration information detection portion 15, and a known storage such as a hard disk device or a semiconductor memory may be used, for example.

Figure 18:
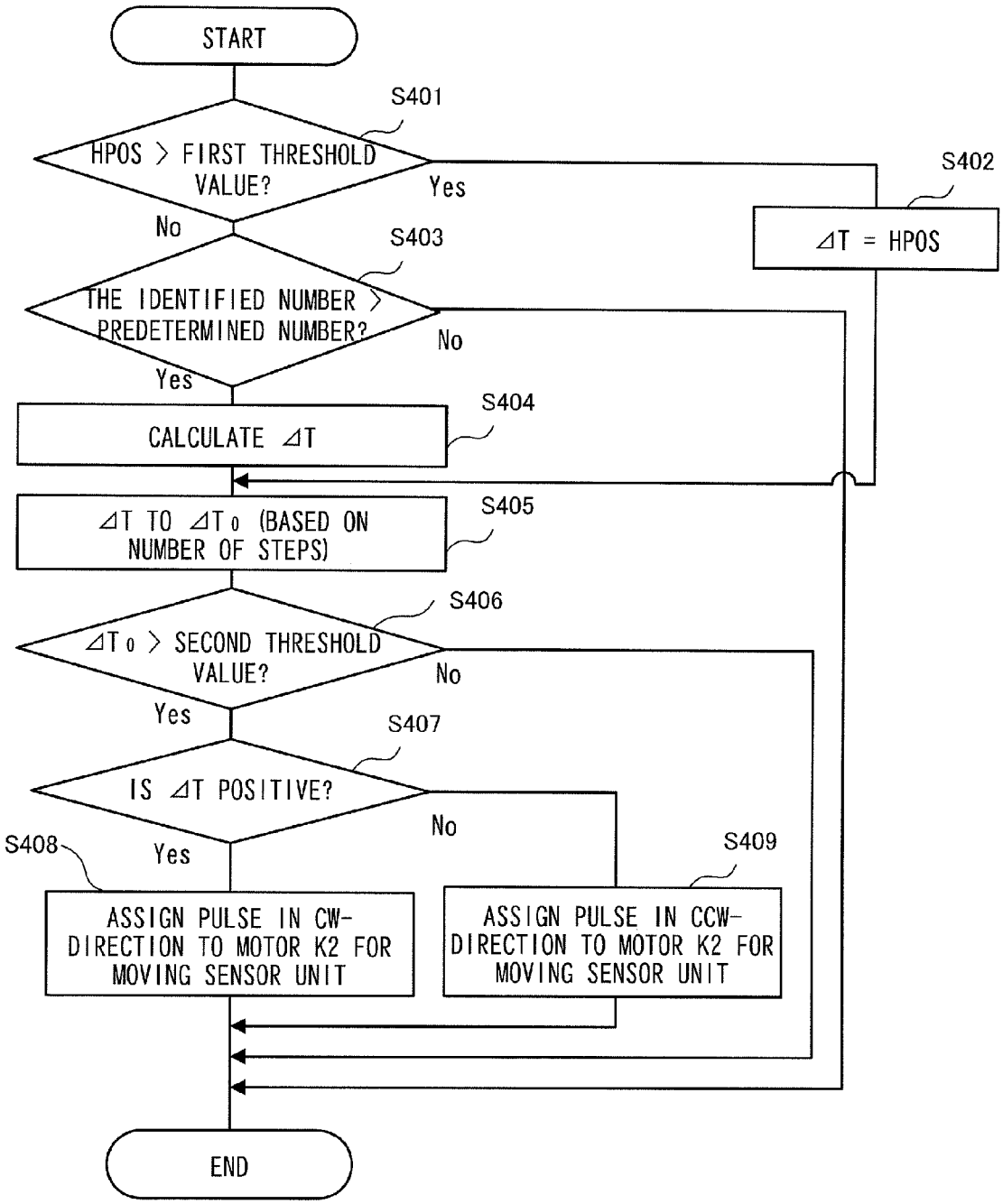
FIG. 18 is a flowchart showing another concrete example of the control processing procedure performed by the image forming apparatus according to the present invention.

FIG. 18 is a flowchart showing another concrete example of the control processing procedure performed by the image forming apparatus according to the present invention. In this concrete example, the information on move history is used.

In the control processing procedure shown in FIG. 18, as in the case of the above-described control processing procedure (see FIG. 15), after identifying the deviation amount HPOS, first, the registration information detection portion 15 compares the identified deviation amount HPOS with a predetermined threshold value (referred to as a "first threshold value," below), to check whether or not the deviation amount HPOS is larger than the first threshold value (S401). If the deviation amount HPOS is larger than the first threshold value, a value ΔT is set at the value of the deviation amount HPOS (S402), and position moving of the sensor unit 12*a* to be described below is performed.

Here, if the deviation amount HPOS is not larger than the first threshold value, the sensor unit 12*a* is not moved for the purpose of eliminating a detection error (approximately ±0.2 mm, for example) notified by the first sensor S1. However, this indicates that, if the sensor position is deviated from the mark center approximately 0.1 to 0.2 mm, no correction is made for the deviation.

In order to avoid such a situation, the registration information detection portion 15 averages the values of a predetermined number of the deviation amounts HPOS on the basis of the information on the history of identified results of the deviation amounts HPOS stored in the storage unit, and then moves the sensor position in accordance with the average value. Here, the predetermined number is 200, for example (the values of the deviation amounts HPOS are counted irrespective of the print distance of the continuous paper P). Specifically, the registration information detection portion 15 checks whether the number of times the deviation amount HPOS is identified has reached the predetermined number, for example, 200 (S403). If the number of times has reached the predetermined number, the registration information detection portion 15 calculates the average value ΔT of the deviation amounts HPOS for the 200 times (S404), and then converts the average value ΔT to a value corresponding to a drive amount of the motor K2 of the mark detection mechanism 470, more specifically, a correction amount $\Delta T_0$ determined on the basis of the number of steps of the motor K2 (S405). Thereafter, the registration information detection portion 15 compares the correction amount $\Delta T_0$ with a predetermined threshold value (referred to as a "second threshold value," below) different from the first threshold value (S406). As a result, if the correction amount $\Delta T_0$ is larger than the second threshold value, the sensor unit 12*a* is moved in accordance with the correction amount $\Delta T_0$, similarly to S305 to S307 in FIG. 15 (S407 to S409).

Thus, when the sensor position is deviated from the mark center approximately 0.1 to 0.2 mm, although not to an extend of exceeding the first threshold value, the deviation of the sensor unit 12*a* for the deviation amount is compensated on the basis of the information on the history stored in the storage unit, by performing move of the sensor unit 12*a* by using the average value ΔT thus obtained.

However, in order to avoid a false operation, the registration information detection portion 15 notified of the deviation amount larger than the first threshold value waits until receiving notification of another correction value next time, without performing move of the sensor unit 12*a* by using the average value ΔT, even when the counted number satisfies a condition of being equal to the predetermined number, i.e., 200.

Here, the average value ΔT desired to be obtained is the average of the deviation amounts HPOS obtained during continuous printing. For this reason, in the case of intermittent printing or the case in which the printing is stopped due to emergency stop or the like, the values need to be reset. Thus, the count value and the value of a resister for average value calculation are reset every time paper feeding is started.

In the first exemplary embodiment, the concrete examples have been described. However, the present invention is not to be limited to the examples.

For example, in the first exemplary embodiment, used is the case where the sensor position is moved in the directions orthogonal to the transport direction of the continuous paper P, that is, the fast scan directions used for the image formation on the continuous paper P. However, the present invention is applicable even when the directions in which the sensor position is moved are not the orthogonal directions as long as it crosses the transport direction of the continuous paper P.

Hence, the present invention is not limited to the first exemplary embodiment, and changes are allowed to be made within the scope of the present invention.

Second Exemplary Embodiment

Next, a second exemplary embodiment is described.

Figure 19:
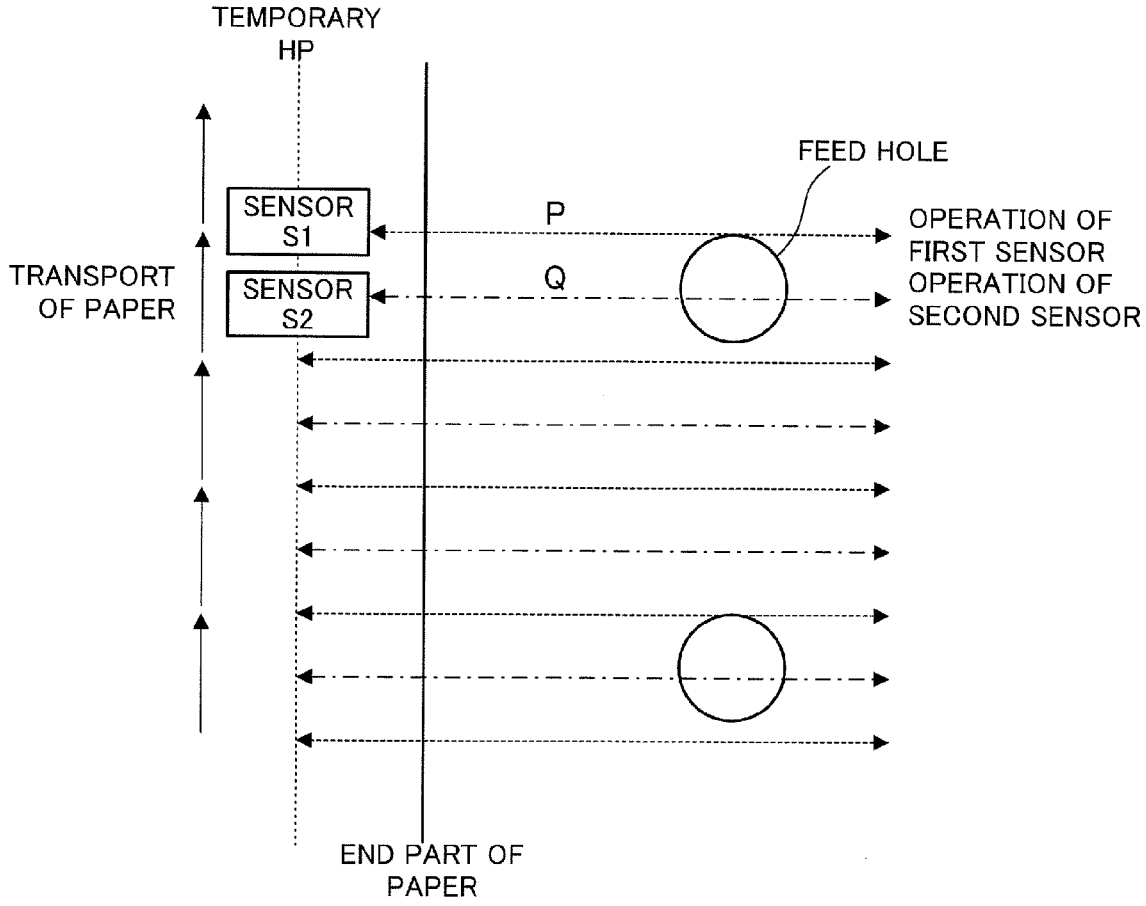
FIG. 19 is a view for explaining operations of the first sensor and the second sensor in the second exemplary embodiment.

FIG. 19 is a view for explaining operations of the first sensor S1 and the second sensor S2 in the second exemplary embodiment.

In the above-described first exemplary embodiment, the first sensor S1 and the second sensor S2 are arranged so as to have a relationship of facing each other, and acquisition of position data pieces by using the first sensor S1 is performed. In such a condition, however, if the transport distance of the continuous paper P in S115 (see FIG. 7) and each interval between feed holes (see B in FIG. 4) are not much different, the detection position of the first sensor S1 may not pass feed holes in some cases. Even if the detection position passes feed holes, the portion on which the detection position passes may be edges of the feed holes.

In light of these possibilities, in the second exemplary embodiment, the first sensor S1 and the second sensor S2 are arranged in positions so as to be away from each other by a predetermined distance (2 mm, for example) in the transport direction (slow scan directions) of the continuous paper P. More specifically, the first sensor S1 is disposed on the downstream side in the transport direction of the continuous paper P, with respect to the second sensor S2. In the second exemplary embodiment, scanning is performed by using the first sensor S1 and the second sensor S2 arranged in the positions not aligned with each other in the slow scan directions as shown in FIG. 19. With this configuration, in the second exemplary embodiment, the detection positions of the sensors pass the feed holes at a higher rate than the case in the first exemplary embodiment. Although the first sensor S1 is disposed on the downstream side in the transport direction of the continuous paper P, with respect to the second sensor S2 in the second exemplary embodiment, the first sensor S1 may be disposed on the upstream side in the transport direction of the continuous paper P, with respect to the second sensor S2, instead.

Figure 20A:
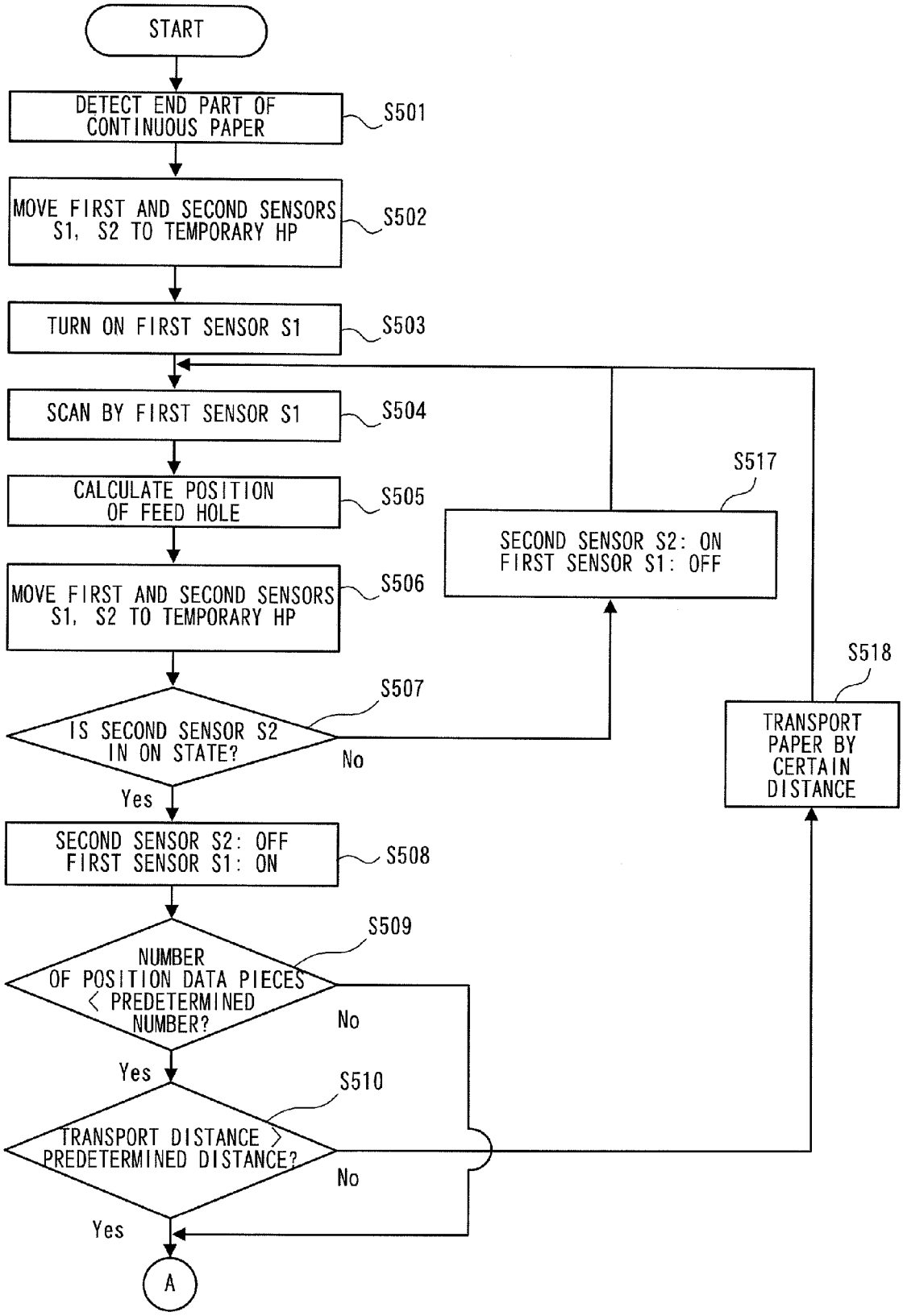
FIGS. 20A and 20B are a flowchart showing processing performed by the controller.
Figure 20B:
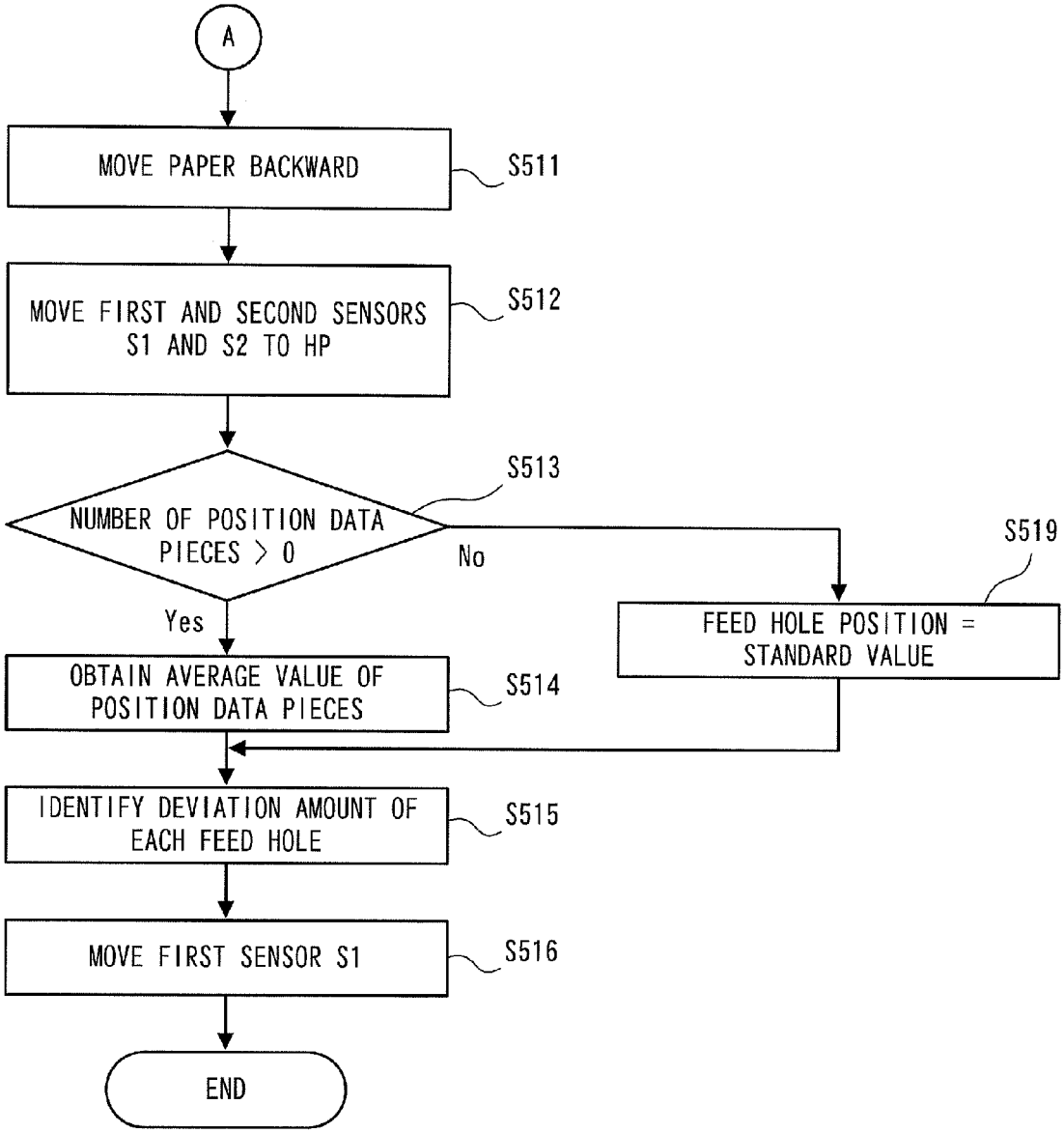

FIGS. 20A and 20B are a flowchart showing processing performed by the controller 420 (see FIG. 1). In the following, detailed descriptions of the same parts of the processing as those in the first exemplary embodiment are omitted.

First, the sensor control portion 421 detects the end part of the continuous paper P by using the end part detection sensor S3 (Step 501), and then moves the first sensor S1 and the second sensor S2 to temporary home positions (Step 502). Thereafter, the sensor control portion 421 turns on the first sensor S1 (Step 503), moves the first sensor S1 as indicated by an arrow P in FIG. 19, and then performs scanning by using the first sensor S1 (Step 504). In this event, the second sensor S2 moves in a corresponding fast scan direction together with the first sensor S1, but does not perform scanning due to be in an off state.

Then, the hole position calculation portion 422 performs calculation processing to obtain the position of a feed hole, on the basis of the scan result from the first sensor S1 (Step 505). Here, since the calculation processing is the same as that in the first exemplary embodiment, the description thereof is omitted. Subsequently, the sensor control portion 421 moves the first sensor S1 and the second sensor S2 to the temporary home positions (Step 506). Then, the sensor control portion 421 checks whether or not the second sensor S2 is in an on state (Step 507), and, if the second sensor S2 is not in an on state, turns on the second sensor S2 while turning off the first sensor S1 (Step 517). Thereafter, the processing from Step 504 to Step 507 is performed again. Here, the second sensor S2 moves in the direction indicated by an arrow Q shown in FIG. 19, by the processing in Step 504. In this event, the first sensor S1 moves in a corresponding fast scan direction together with the second sensor S2, but does not perform scanning due to being in an off state.

If the sensor control portion 421 determines that the second sensor S2 is in an on state in Step 507, on the other hand, the sensor control portion 421 turns off the second sensor S2 while turning on the first sensor S1 (Step 508). Then, the check portion 424 reads out the position data pieces (the distances A1) from the position data storage portion 423 to check whether or not the number of the position data pieces has reached a predetermined number, more specifically, whether or not the number of the position data pieces is smaller than the predetermined number (Step 509). When the check portion 424 determines that the number of the data pieces is smaller than the predetermined number, the paper transport control portion 425 checks, as in the first exemplary embodiment, whether or not the transport distance of the continuous paper P from the initial position is larger than a predetermined distance (Step 510). When determining that the transport distance is larger than the predetermined distance in Step 510, the paper transport control portion 425 moves the continuous paper P backward (Step 511), so that the continuous paper P returns to the initial position.

On the other hand, when the check portion 424 determines in Step 509 that the number of the position data pieces is not smaller than the predetermined number, that is, when the number of the data pieces has reached the predetermined number, the processing in Step 510 is omitted, and the paper transport control portion 425 performs the processing in Step 511, specifically, moves the continuous paper P backward.

By contrast, when determining in Step 510 that the transport distance of the continuous paper P from the initial position is not larger than the predetermined distance, that is, the transport distance of the continuous paper P has not reached the predetermined distance, the paper transport control portion 425 transports (moves forward) the continuous paper P by a certain distance (⅙ inch, for example) (Step 518). Thereafter, the processing from Step 504 to Step 509 is performed again.

Thereafter, the sensor control portion 421 moves the first sensor S1 and the second sensor S2 to the home positions (Step 512). In this event, the sensor control portion 421 causes the first sensor S1 to be in an off state. Then, the check portion 424 checks whether or not the number of the position data pieces is larger than 0 (zero) (Step 513). If the check portion 424 determines that the number of data pieces is larger than 0 (zero), the deviation amount identification portion 426 obtains the average value of the position data pieces (the distances A1) (Step 514).

Subsequently, the deviation amount identification portion 426 acquires the standard value (6 mm, for example; see A in FIG. 4) from a memory such as the ROM, and then performs calculation (average value−standard value), to identify the deviation amount of each feed hole with respect to the standard value (Step 515). Then, the sensor control portion 421 determines the position in which the first sensor S1 is to be disposed, by adding the deviation amount to the distance LM (see FIG. 5B), and causes the motor K2 to drive, in order to move the first sensor S1 from the home position to the determined position (Step 516). On the other hand, if the check portion 424 determines in Step 513 that the number of the position data pieces is not larger than 0 (zero), that is, no position data piece exists, the deviation amount identification portion 426 sets the distance from the end part of the continuous paper P to the center of each feed hole (feed hole position) at the standard value (Step 519), as in the first exemplary embodiment.

Third Exemplary Embodiment

Next, a third exemplary embodiment is described. In the above-described first and second exemplary embodiments, the position of each feed hole is obtained by moving the first sensor S1 and the like with respect to the continuous paper P in a transport stop state. However, the position of each feed hole is also obtainable by transporting the continuous paper P with respect to the first sensor S1 and the like in a stop state.

FIGS. 21A to 21D are views showing an example of operations of the first sensor S1 and the like in the third exemplary embodiment.

Figure 21A:
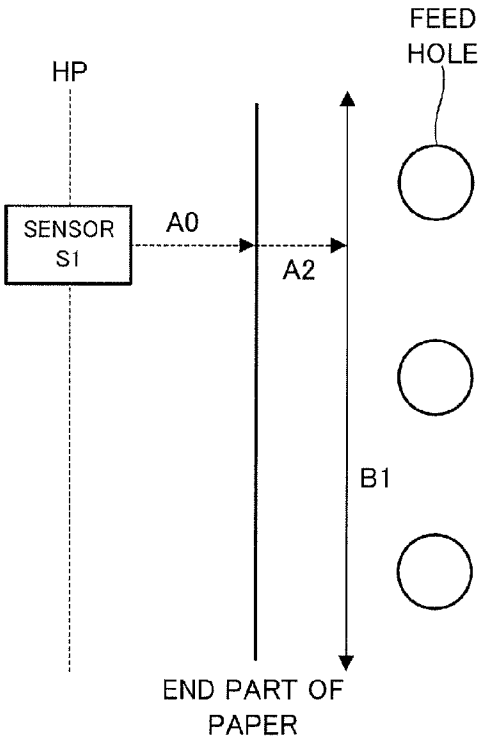
FIGS. 21A to 21D are views showing an example of operations of the first sensor and the like in the third exemplary embodiment.

In the third exemplary embodiment, first, the first sensor S1 is moved from the home position toward the continuous paper P as indicated by an arrow A0 in FIG. 21A, to detect the end part of the continuous paper P. Then, as indicated by an arrow A2 in FIG. 21A, the first sensor S1 is moved by a predetermined amount inside the continuous paper P, and the continuous paper P is then moved forward in the direction indicated by an arrow B1 to acquire an output signal from the first sensor S1. After receipt of the output signal from the first sensor S1, the continuous paper P returns to the position located before the forward move.

Figure 21B:
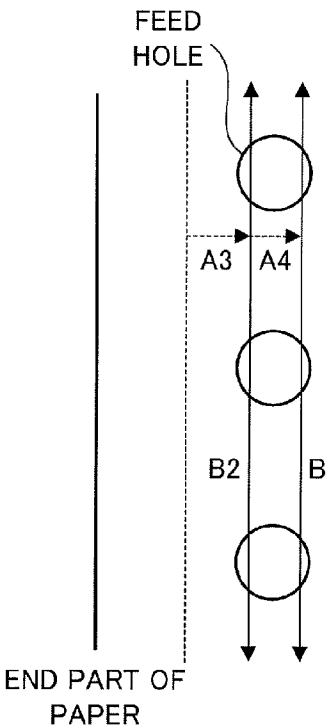

If no feed hole is detected from the output signal, the first sensor S1 is moved further inside the continuous paper P as indicated by an arrow A3 in FIG. 21B. Thereby, in the third exemplary embodiment, feed holes pass the detection position of the first sensor S1, and are thus detected. In the third exemplary embodiment, the move amount of the first sensor S1 for each time is set equal to or smaller than half a diameter of each feed hole. For this reason, when a feed hole becomes detectable after the move of the first sensor S1 indicated by the arrow A3, the detection position of the first sensor S1 corresponds to a left side part of the feed hole.

Figure 21C:
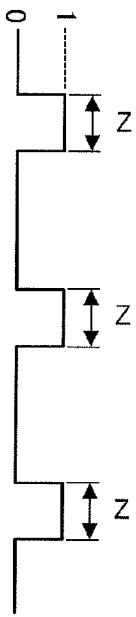

Then, on the basis of the output signal from the first sensor S1, the position of the first sensor S1 above the left side part of the feed hole (a first position) is identified. Specifically, the output signal from the first sensor S1 is as shown in FIG. 21C, for example, and the width Z of each part corresponding to "1" in the output signal is obtained. Then the average value of the widths Z is obtained, so that the position of the first sensor S1 is identified on the basis of the average value.

Subsequently, on the basis of a predetermined amount or the first position, the first sensor S1 is moved further inside the continuous paper P so that the detection position of the first sensor S1 would position above a right side part of each feed hole (see an arrow A4 in FIG. 21B). Thereafter, the continuous paper P is moved forward and backward. On the basis of an output signal from the first sensor S1, a position of the first sensor S1 above the right side part of the feed hole (a second position) is identified.

Figure 21D:
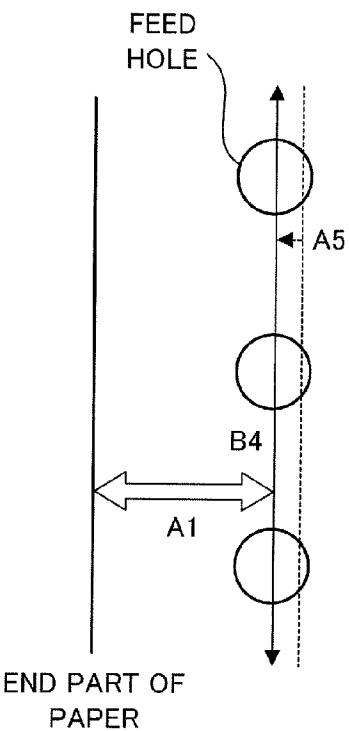
Figure 21D:
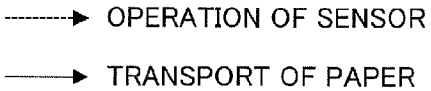

Then, on the basis of the first position and the second position, the center of each feed hole is estimated, and the first sensor S1 is moved to the estimated position (see an arrow A5 in FIG. 21D). The continuous paper P is moved forward in the direction indicated by an arrow B4 to obtain an output signal from the first sensor S1, and the continuous paper P is moved backward. The average value of the widths Z is obtained on the basis of the output signal as described above, and checks whether or not the average value is within a predetermined range. If the average value is within the range, the current position is determined as the center of each feed hole, and the distance A1 from the end part of the paper to the current position is obtained as the position of each feed hole.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A medium transport apparatus comprising:

a transport unit that transports a recording medium continuing in a direction, in the direction where the recording medium continues;

a detection unit that detects a mark formed on the recording medium transported by the transport unit, by using a detection effective range in a direction crossing a transport direction of the recording medium;

a positional relationship identification unit that identifies a relative positional relationship between the detection unit and the mark in the direction crossing the transport direction, from a detection result obtained by the detection unit; and a move unit that moves the detection unit in the direction crossing the transport direction, on the basis of the relative positional relationship identified by the positional relationship identification unit, wherein the recording medium is a continuous paper having portions defining feed holes regularly formed in the direction, the medium transport apparatus further comprises:

an identification unit that identifies, from the detection result from the detection unit, a position of the portions defining the feed holes in width directions of the continuous paper from an end part of the continuous paper; and a determination unit that determines a destination position to which the detection unit is to be moved, on the basis of an identification result obtained by the identification unit, and the move unit moves the detection unit to the destination position determined by the determination unit before moving the detection unit.

2. The medium transport apparatus according to claim 1, wherein the positional relationship identification unit identifies, as the relative positional relationship between the detection unit and the mark, a deviation amount between a center position of the detection effective range of the detection unit in the direction crossing the transport direction and a center position of the mark in the direction crossing the transport direction, and the move unit moves the detection unit on the basis of the deviation amount identified by the positional relationship identification unit, so as to align the center position of the detection effective range of the detection unit in the fast scan direction with the center position of the mark in the fast scan direction.

3. The medium transport apparatus according to claim 2, wherein the positional relationship identification unit compares the deviation amount with a threshold value stored in a memory unit, and the move unit moves the detection unit when the positional relationship identification unit determines that the deviation amount is larger than the threshold value.

4. The medium transport apparatus according to claim 3, wherein the positional relationship identification unit compares a move amount of the detection unit identified from the deviation amount with a predetermined maximum value stored in the memory unit, and the move unit replaces the move amount of the detection unit with the predetermined maximum value when the positional relationship identification unit determines that the move amount of the detection unit is larger than the predetermined maximum value.

5. The medium transport apparatus according to claim 4, further comprising a memory that stores any one of information on an accumulated amount of movement of the detection unit by the move unit and information on history of the movement.

6. The medium transport apparatus according to claim 1, wherein the identification unit identifies the position of the portions defining the feed holes by using an output from the detection unit.

7. The medium transport apparatus according to claim 6, said detection unit comprises a first sensor and a second sensor fixedly positioned therein, wherein the determination unit causes the move unit to move said first sensor in the width directions while moving the second sensor placed in a position different from a position of the first sensor in a transport direction of the continuous paper, in the width directions, and identifies the position of the portions defining the feed holes by using an output from the first sensor and an output from the second sensor.

8. The medium transport apparatus according to claim 7, wherein the second sensor is provided so as to face a first surface of the continuous paper opposite to a second surface including the mark formed on the continuous paper, and is configured to be capable of detecting another mark formed on the first surface.

9. The medium transport apparatus according to claim 8, wherein the determination unit causes the move unit to cause the first sensor and the second sensor to reciprocate in the width directions, and identifies the position of the portions defining the feed holes by using the output from the first sensor and the second sensor, and the transport unit transports the continuous paper each time the first sensor and the second sensor are caused to reciprocate by the identification unit.

10. The medium transport apparatus according to claim 1, wherein the identification unit identifies, from the detection result from the detection unit, a distance from the end part of the continuous paper to the portions defining the feed holes, and the determination unit obtains a difference between the distance identified by the identification unit and a standard value, and determines the destination position of the detection unit on the basis of the difference.

11. An image forming apparatus comprising:

a transport unit that transports a recording medium continuing in a direction, in the direction where the recording medium continues;

an image forming unit that forms an image on the recording medium transported by the transport unit;

a detection unit that detects a mark formed on the recording medium transported by the transport unit, by using a detection effective range in a direction crossing a transport direction of the recording medium;

a positional relationship identification unit that identifies a relative positional relationship between the detection unit and the mark in the direction crossing the transport direction, from a detection result obtained by the detection unit; and a move unit that moves the detection unit in the direction crossing the transport direction, on the basis of the relative positional relationship identified by the positional relationship identification unit, wherein the recording medium is a continuous paper having portions defining feed holes regularly formed in the direction, the image forming apparatus further comprises:

an identification unit that identifies, from the detection result from the detection unit, a position of the portions defining the feed holes in width directions of the continuous paper from an end part of the continuous paper; and a determination unit that determines a destination position to which the detection unit is to be moved, on the basis of an identification result obtained by the identification unit, and the move unit moves the detection unit to the destination position determined by the determination unit before moving the detection unit on the basis of the relative positional relationship identified by the positional relationship identification unit.

12. A medium transport method comprising:

transporting a recording medium continuing in a direction, in the direction where the recording medium continues;

detecting a mark formed on the recording medium thus transported, by using a detection effective range of a detection unit, the detection effective range in a direction crossing a transport direction of the recording medium;

identifying a relative positional relationship between the detection unit and the mark in the direction crossing the transport direction, from a detection result obtained by the detection unit; and moving the detection unit in the direction crossing the transport direction, on the basis of the relative positional relationship, wherein the recording medium is a continuous paper having portions defining feed holes regularly formed in the direction, the method further comprises:

an identifying step for identifying, from the detection result from the detection unit, a position of the portions defining the feed holes in width directions of the continuous paper from an end part of the continuous paper; and a determination step for determining a destination position to which the detection unit is to be moved, on the basis of an identification result obtained by the identifying step, and moving the detection unit to the destination position determined by the determination step before moving the detection unit on the basis of the relative positional relationship identified by the positional relationship identification unit.

13. A medium transport apparatus comprising:

a transport unit that transports a recording medium continuing in a direction, in the direction where the recording medium continues;

a detection unit that detects a mark formed on the recording medium transported by the transport unit, by using a detection effective range in a direction crossing a transport direction of the recording medium;

a positional relationship identification unit that identifies a relative positional relationship between the detection unit and the mark in the direction crossing the transport direction, from a detection result obtained by the detection unit; and a move unit that moves the detection unit in the direction crossing the transport direction, on the basis of the relative positional relationship identified by the positional relationship identification unit, wherein the positional relationship identification unit identifies, as the relative positional relationship between the detection unit and the mark, a deviation amount between a center position of the detection effective range of the dectection unit in the direction crossing the transport direction and a center position of the mark in the direction crossing the transport direction, the move unit moves the detection unit on the basis of the deviation amount identified by the positional relationship identification unit, so as to align the center position of the detection effective range of the detection unit in the fast scan direction with the center position of the mark in the fast scan direction, the positional relationship identification unit compares a move amount of the detection unit identified from the deviation amount with a predetermined maximum value stored in a memory unit, and the move unit replaces the move amount of the detection unit with the predetermined maximum value when the positional relationship identification unit determines that the move amount of the detection unit is larger than the predetermined maximum value.

* * * * *